US008282172B2

(12) United States Patent
Schmitz et al.

(10) Patent No.: US 8,282,172 B2
(45) Date of Patent: Oct. 9, 2012

(54) SEAT

(75) Inventors: Johann Burkhard Schmitz, Berlin (DE); Carola Eva Marianne Zwick, Berlin (DE); Roland Rolf Otto Zwick, Berlin (DE); Claudia Plikat, Berlin (DE)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 13/206,039

(22) Filed: Aug. 9, 2011

(65) Prior Publication Data

US 2011/0291453 A1 Dec. 1, 2011

Related U.S. Application Data

(63) Continuation of application No. 12/225,335, filed as application No. PCT/IB2007/000745 on Mar. 22, 2007, now Pat. No. 7,992,936.

(30) Foreign Application Priority Data

| | | |
|---|---|---|
| Mar. 24, 2006 | (DE) | 10 2006 014 109 |
| Apr. 26, 2006 | (DE) | 10 2006 020 006 |
| Apr. 26, 2006 | (DE) | 10 2006 020 007 |
| Jul. 21, 2006 | (DE) | 10 2006 034 307 |
| Jul. 27, 2006 | (DE) | 10 2006 035 553 |
| Aug. 24, 2006 | (DE) | 10 2006 039 606 |

(51) Int. Cl.
*A47C 7/02* (2006.01)

(52) U.S. Cl. ..... 297/452.15; 297/452.12; 297/452.14; 297/452.18

(58) Field of Classification Search ..... 297/451.12, 297/452.13, 452.14, 452.15, 452.18
See application file for complete search history.

(56) References Cited

U.S. PATENT DOCUMENTS

| | | | |
|---|---|---|---|
| 946,225 | A | 1/1910 | Irwin |
| 2,771,122 | A | 11/1956 | Straub |
| 3,041,109 | A | 6/1962 | Eames et al. |
| 3,120,407 | A | 2/1964 | Propst |

(Continued)

FOREIGN PATENT DOCUMENTS

| | | | |
|---|---|---|---|
| AU | 6563380 | A1 | 1/1983 |

(Continued)

OTHER PUBLICATIONS

Faraday, "Exploring Biomimetrics for Products & Packaging," Sep. 27, 2007, 3 pages.

(Continued)

*Primary Examiner* — Laurie Cranmer
(74) *Attorney, Agent, or Firm* — Brinks Hofer Gilson & Lione

(57) ABSTRACT

A seating structure including a base, a pair of laterally spaced support arms each having a seat portion and a backrest portion and a transition portion joining the seat portion and backrest portion, wherein the support arms are coupled to the base. A body support member extends between and is connected to the support arms and includes at least a seat portion and a backrest portion. A support element is coupled to the base and includes a central support arm extending upwardly along a centerline of the backrest portion of the body support member. The central support arm is spaced rearwardly from the backrest portions of the support arms and further includes a pair of laterally extending struts connecting the central support arm and the laterally spaced support arms.

18 Claims, 19 Drawing Sheets

U.S. PATENT DOCUMENTS

| | | | | |
|---|---|---|---|---|
| 3,230,011 | A | 1/1966 | Propst | |
| 3,300,251 | A | 1/1967 | Helms | |
| 3,586,370 | A | 6/1971 | Barecki et al. | |
| 3,640,576 | A | 2/1972 | Morrison et al. | |
| 3,844,612 | A | 10/1974 | Borggren | |
| 3,877,750 | A | 4/1975 | Scholpp | |
| D235,298 | S | 6/1975 | Schuyler | |
| 4,036,527 | A | 7/1977 | Faul | |
| 4,062,590 | A | 12/1977 | Polsky et al. | |
| 4,230,365 | A | 10/1980 | Messinger | |
| 4,251,106 | A * | 2/1981 | Gilbert | 297/18 |
| 4,522,444 | A * | 6/1985 | Pollock | 297/239 |
| 4,592,126 | A | 6/1986 | Bottemiller | |
| 4,889,385 | A | 12/1989 | Chadwick et al. | |
| 4,913,493 | A | 4/1990 | Heidmann | |
| 5,029,942 | A | 7/1991 | Rink | |
| D320,034 | S | 9/1991 | Brooks et al. | |
| 5,240,308 | A | 8/1993 | Goldstein | |
| 5,328,245 | A | 7/1994 | Marks | |
| 5,352,022 | A | 10/1994 | Knoblock | |
| 5,518,294 | A | 5/1996 | Ligon, Sr. et al. | |
| 5,582,459 | A * | 12/1996 | Hama et al. | 297/300.2 |
| D377,431 | S | 1/1997 | Stumpf et al. | |
| 5,649,743 | A | 7/1997 | Skalka | |
| 5,660,439 | A * | 8/1997 | Unwalla | 297/316 |
| D386,023 | S | 11/1997 | Stumpf et al. | |
| D390,026 | S | 2/1998 | Biecher | |
| 5,954,399 | A | 9/1999 | Hong | |
| 5,975,634 | A | 11/1999 | Knoblock et al. | |
| 6,015,187 | A | 1/2000 | Roslund, Jr. et al. | |
| 6,059,368 | A | 5/2000 | Stumpf et al. | |
| D436,259 | S | 1/2001 | Nagamitsu | |
| D436,260 | S | 1/2001 | Nagamitsu | |
| D437,132 | S | 2/2001 | Nagamitsu | |
| D441,977 | S | 5/2001 | Vaaler | |
| D442,383 | S | 5/2001 | Bell | |
| D444,309 | S | 7/2001 | Nagamitsu | |
| 6,257,665 | B1 * | 7/2001 | Nagamitsu et al. | 297/285 |
| 6,439,661 | B1 * | 8/2002 | Brauning | 297/300.2 |
| D465,347 | S | 11/2002 | Bell | |
| 6,505,890 | B2 | 1/2003 | Riley et al. | |
| D469,618 | S | 2/2003 | Nagamitsu | |
| D469,970 | S | 2/2003 | Molteni | |
| 6,513,874 | B1 | 2/2003 | Sander et al. | |
| 6,568,760 | B2 * | 5/2003 | Davis et al. | 297/440.14 |
| 6,572,190 | B2 * | 6/2003 | Koepke et al. | 297/284.1 |
| 6,582,190 | B2 | 6/2003 | Koepke et al. | |
| D476,493 | S | 7/2003 | Nagamitsu | |
| D476,820 | S | 7/2003 | Nagamitsu | |
| 6,609,754 | B2 | 8/2003 | Rajasinghan | |
| D481,560 | S | 11/2003 | Vidmar et al. | |
| D482,542 | S | 11/2003 | Pluer | |
| D487,359 | S | 3/2004 | Giugiaro | |
| D489,542 | S | 5/2004 | Giugiaro | |
| 6,749,261 | B2 | 6/2004 | Knoblock et al. | |
| 6,761,406 | B2 * | 7/2004 | Kinoshita et al. | 297/296 |
| 6,820,933 | B2 | 11/2004 | Fereira Da Silva | |
| 6,896,328 | B2 | 5/2005 | Goodworth | |
| D509,969 | S | 9/2005 | Loew et al. | |
| D511,629 | S | 11/2005 | Caldwell | |
| D512,578 | S | 12/2005 | Igarashi | |
| D512,579 | S | 12/2005 | Igarashi | |
| D513,910 | S | 1/2006 | Gehry | |
| 6,986,549 | B2 * | 1/2006 | Kniese | 297/284.1 |
| 6,991,291 | B2 * | 1/2006 | Knoblock et al. | 297/284.4 |
| D514,345 | S | 2/2006 | Igarashi | |
| D514,838 | S | 2/2006 | Igarashi | |
| D526,495 | S | 8/2006 | Albin | |
| 7,097,249 | B2 | 8/2006 | Igarashi et al. | |
| D527,920 | S | 9/2006 | Giugiaro | |
| D528,810 | S | 9/2006 | Giugiaro | |
| D528,811 | S | 9/2006 | Giugiaro | |
| D528,812 | S | 9/2006 | Giugiaro | |
| D540,557 | S | 4/2007 | Doughty | |
| D542,549 | S | 5/2007 | Hara | |
| D542,580 | S | 5/2007 | Loew et al. | |
| D543,039 | S | 5/2007 | Hara | |
| D543,040 | S | 5/2007 | Hara | |
| D543,041 | S | 5/2007 | Hara | |
| D543,042 | S | 5/2007 | Hara | |
| D543,369 | S | 5/2007 | Hara | |
| D543,371 | S | 5/2007 | Wang | |
| D543,385 | S | 5/2007 | Loew et al. | |
| D543,397 | S | 5/2007 | Loew et al. | |
| D543,736 | S | 6/2007 | Shields | |
| 7,226,127 | B1 * | 6/2007 | Yevko et al. | 297/284.1 |
| 7,237,841 | B2 * | 7/2007 | Norman et al. | 297/301.3 |
| 7,243,993 | B2 | 7/2007 | Igarashi et al. | |
| 7,252,336 | B2 | 8/2007 | Frisina | |
| D550,471 | S | 9/2007 | Igarashi | |
| D550,977 | S | 9/2007 | Igarashi | |
| D552,368 | S | 10/2007 | Scheper et al. | |
| D552,882 | S | 10/2007 | Saotome | |
| D554,384 | S | 11/2007 | Scheper et al. | |
| D555,924 | S | 11/2007 | Igarashi | |
| D557,921 | S | 12/2007 | Kane | |
| D559,000 | S | 1/2008 | Vanderminden, Sr. | |
| D572,915 | S | 7/2008 | Doughty | |
| D573,816 | S | 7/2008 | Muller | |
| 7,396,079 | B2 * | 7/2008 | Heidmann et al. | 297/285 |
| 7,422,287 | B2 * | 9/2008 | Heidmann et al. | 297/354.1 |
| 7,425,037 | B2 * | 9/2008 | Schmitz et al. | 297/300.2 |
| 2003/0189367 | A1 | 10/2003 | Erker | |
| 2004/0032156 | A1 | 2/2004 | Stipek | |
| 2006/0181126 | A1 * | 8/2006 | Eysing | 297/284.1 |
| 2006/0238009 | A1 | 10/2006 | Igarashi et al. | |
| 2006/0244295 | A1 | 11/2006 | Igarashi et al. | |
| 2008/0264425 | A1 | 10/2008 | Mundell | |
| 2009/0042014 | A1 | 2/2009 | Synnestvedt et al. | |
| 2009/0102268 | A1 | 4/2009 | Schmitz et al. | |
| 2010/0289308 | A1 | 11/2010 | Schmitz et al. | |

FOREIGN PATENT DOCUMENTS

| | | | |
|---|---|---|---|
| DE | 4433663 | A1 | 9/1996 |
| DE | 19916411 | A1 | 11/2000 |
| EP | 049310 | B1 | 3/1985 |
| EP | 00250109 | A1 | 12/1987 |
| EP | 860355 | A1 | 8/1998 |
| EP | 1040999 | A2 | 10/2000 |
| EP | 1316651 | A2 | 6/2003 |
| FR | 2715124 | A1 | 7/1995 |
| JP | D1284784 | | 10/2006 |
| LU | 88528 | A1 | 3/1996 |
| WO | WO 2007/110737 | A2 | 10/2007 |
| WO | WO 2009/039231 | A3 | 3/2009 |

OTHER PUBLICATIONS

Herman Miller for Business, "Eames Aluminum Group & Soft Pad Chairs," [online][retrieved from internet: URL http://www.hermanmiller.com/CDA/SSA/Product/1,1592,a10-c440-p39,00.html], [retrieved—date unknown], 2 pages.

International Search Report in International Application No. PCT/IB07/00721, dated Sep. 5, 2008, 3 pages.

International Search Report in International Application No. PCT/IB07/00745, dated Jul. 17, 2008, 2 pages.

International Search Report in International Application No. PCT/US08/76768, dated Mar. 10, 2009, 1 page.

Md, Magazine of Design, 5 pages, Oct. 2006.

Okamura Corporation, "Baron Ergonomic Mesh Chair," copyright 2005, [online][retrieved from internet: URL: http://www.okamura.co.jp/english/product/office/baron/index.html], [retrieved on Mar. 31, 2008], 1 page.

U.S. Appl. No. 29/291,968, filed Sep. 21, 2007, Schmitz et al. as filed, 50 pages.

United States Patent and Trademark Office, Trademark, Principal Register, Reg. No. 3,105,591, registered Jun. 20, 2006, 1 page.

U.S. Appl. No. 12/225,334, filed Mar. 22, 2007, Schmitz et al. as filed, 68 pages.

U.S. Appl. No. 12/284,159, filed Sep. 18, 2008, Schmitz et al. as filed, 125 pages.

Written Opinion in International Application No. PCT/IB07/00721, dated Sep. 5, 2008, 6 pages.

Written Opinion in International Application No. PCT/IB07/00745, dated Jul. 17, 2008, 4 pages.
Written Opinion of the International Searching Authority for International Application No. PCT/US2008/076768, dated Mar. 10, 2009, 7 pages.
Office Action from co-pending U.S. Appl. No. 12/284,159, dated Jun. 10, 2010, 10 pages.
Notice of Allowance from co-pending U.S. Appl. No. 12/284,159, dated Dec. 14, 2010, 7 pages.

* cited by examiner

SEAT

This application is a continuation of U.S. application Ser. No. 12/225,335, filed Sep. 18, 2008 now U.S. Pat. No. 7,992,936, which was the National Stage of International Application No. PCT/IB07/00745, filed Mar. 22, 2007, the entire disclosures of which are hereby incorporated herein by reference.

FIELD OF INVENTION

The invention relates to a seat which comprises an underframe and a seat element, the seat element comprising a front seat part, a rear seat part, a lower backrest part and an upper backrest part.

BACKGROUND

DE 42 35 691 C2 describes a seat in which the seat is to be automatically adapted to the body weight of the particular user. A drawback of seats of this type is the enormous constructional complexity which leads to high costs and to the seat being heavy.

BRIEF SUMMARY

The invention is based on the object of developing a seat, in which, in order to provide basic compensation for different body weights of the individuals using the seat, the use of a weighing device in the sense of a complex mechanism, in which movements are used to automatically change spring forces or spring characteristics, is to be omitted.

This object is achieved, for example and without limitation, by the features of Claim 1. Advantageous and expedient developments are provided in the subclaims.

The seat according to the invention has a front seat part, a rear seat part, a lower backrest part and an upper backrest part, which comprise at least one supporting arm, the supporting arm being composed of at least one upper support and at least one lower support, the upper support being guided in a region A of the front seat part by at least one guide element, the upper support and the lower support being connected to each other in a region D of the upper backrest part, the upper support and the lower support having an arcuate profile in the region B of the rear seat part and in the region C of the lower backrest part, the upper support and the lower support being positioned with respect to each other in the region B of the rear seat part or in the region C of the lower backrest part by at least one connecting link, and the front seat part being able to be pulled back by the upper support with a pulling-back movement directed towards the backrest parts C, D if, when the backrest part is loaded by an individual leaning against it, the seat element is displaced from a basic position I into a resting position II. By this means, a movement by means of which the seat part is actively pulled back can be produced by the seat element. The active displacement or deformation of the seat element makes it possible to influence the position of an individual sitting on the seat relative to the underframe of the seat and, by this means, to counteract the loss of potential energy when the individual leans back into the resting position II. This compensation takes place in order to keep the restoring force, which has to be applied by the backrest part to comfortably move the individual from the resting position II into the basic position I, low or to make it entirely superfluous. The core of the invention is a seat with at least one supporting arm by means of which an active movement of the front seat part can be produced by a largely defined change in shape.

Furthermore, the invention makes provision, by means of the pulling-back movement, to bring about a movement of the front seat part or of the upper support with a horizontal component or a vertical, upwardly directed component. By means of the movement of the front seat part upwards and in the direction of the backrest part, it is possible, as an individual sitting on the seat leans back, to raise his lower body gently from the basic position I into the resting position II or into any intermediate position by means of the front seat part. By this means, a loss of potential energy due to the lowering of the upper body of the individual can be compensated for by the backrest part. The opposed movements of the seat part and of the backrest part permit a seesaw movement or rocking movement, similar to a seesaw or a beam-balance, of the individual on the seat, which movement can take place very substantially independently of the individual's body weight. A presetting of a spring that is dependent on the body weight of the individual using the seat can therefore be basically or very substantially omitted, since the deformation of the seat element brings about a compensation which is independent of the body weight. That is to say, each individual using the seat forms a counterweight as a function of the body weight with a proportion of the body weight itself and thereby brings about intrinsic compensation.

According to the invention, elastic deformability of the supporting arm or of the upper support and/or of the lower support is provided at least in the region B of the rear seat part and in the region C of the lower backrest part. This makes it possible to change a radius of curvature of the supports and therefore also a relative movement between the two supports, by means of which the front seat part can then also be moved.

According to the invention, the guide element, which guides the upper support in the region of the front seat part on the lower support or on the underframe, is essentially designed as a lever arm which is fastened rotatably to the upper support and rotatably to the lower support or to the underframe. This makes it possible, using simple means, to define a movement on a circular path, which movement has a horizontally directed component and a component directed vertically upwards during a movement from the basic position I into the resting position II.

Alternatively, the invention makes provision to design the guide element as a slotted-guide mechanism in which the upper support is movable in the region of the front seat part relative to the lower support or to the underframe. In the case of a slotted-guide mechanism, a curve on which the front seat part or the upper support moves can be very substantially freely selected. By this means, a complicated coupling mechanism for defining a curve for the movement of the upper support can be omitted.

According to a first variant embodiment, as the connecting link or mechanical connecting link between the upper support and the lower support, the invention provides a lever which is connected rotatably in each case to the upper support and the lower support. This makes it possible to define the profile of a relative movement executed by the two supports during the transition from the basic position I into the resting position II, with the supports being pulled towards each other or pushed apart from each other during their opposed displacement depending on the positioning of the bearing points of the lever. Instead of a lever which is mounted by means of bolts, use of clasps or clips is also provided.

According to a second variant embodiment, the invention makes provision to form the connecting link between the upper support and the lower support by at least one slotted-guide mechanism. It is possible to define, by means of a connecting link of this type, any desired curves on which the supports move during corresponding loading.

According to a third variant embodiment, the invention makes provision to form the connecting link between the upper support and the lower support by an elastic element. This makes it possible to reduce the elastic deformation of the upper and/or lower support, since the bearing element used as the bearing can also be deformed and therefore can store energy. In particular, a rubber block which is adhesively bonded to the supports is provided as the bearing.

The invention provides an energy store which, in particular, is adjustable. By this means, for example, particular seat loads caused, for example, by the body build of individuals using the seat can be compensated for.

The invention provides, as energy store, for example, a spring element counter to which the upper support can be pulled back in the direction of the backrest part. A spring element of this type can be realized with little outlay and requires little construction space.

The invention also provides a guided rocking movement of the seat element on the underframe, with there being approximately an equilibrium of forces between the seat part and the backrest part in every seat position between the basic position I and the resting position II. By this means, the function of the seat is largely independent of the body weight of an individual using the seat.

Furthermore, the invention makes provision to fasten the lower support of the supporting arm to the underframe. By this means, the upper support of the supporting arm obtains the required degrees of freedom in order, despite the guide element, despite the at least one connecting link and despite the connection to the lower support in the region of the upper backrest part, to compensate for the shifting of the weight of an individual using the seat.

The invention also provides an L-shaped profile of the supporting arm or of the supports of the supporting arm in the side view of the seat. This makes it possible to use the supporting arm as a supporting component of the seat element and to use it both to control the sequence of movement of the seat element and to form the seat part itself. In principle, every supporting arm is designed as an arcuate clamp which has two legs running next to each other and at a distance from each other, the legs forming the supports. Between a clamp head, in which the two legs are connected to each other or merge one into the other, and free ends of the legs, the legs are connected by at least one connecting link. The free end of the upper leg of the clamp, which end forms the seat surface or bears the latter, is guided on the lower leg or on the underframe by a guide element.

According to the invention, in the basic position I and in the resting position II, an upper pivotal point of the guide element is located higher than a lower pivotal point of the guide element, the upper pivotal point being at a greater distance from the backrest part than the lower pivotal point. This defines a movement clearance of the front seat part, in which the front seat part rises continuously from the basic position I into the resting position II and moves continuously in the direction of the backrest.

According to the invention, during a loading of the seat element by a person leaning back against the backrest part, the connecting link is rotatable by the supports and is displaceable with the latter. The connecting link therefore constitutes a connection between the supports, which connection permits the supports or the supporting arm to have a delimited movement.

A variant embodiment of the invention provides a seat in which the supporting arm is formed by a left, upper support and a right, upper support and a lower support situated between them, the lower support being connected to the left, upper support by at least one mechanical connecting link, and the lower support being connected to the right, upper support by at least one mechanical connecting link. By this means, with just one supporting arm, a seat or a seat element can be brought about, in which a supporting arm suffices in order to carry a covering which serves as the seat surface and backrest.

Furthermore, in the case of a supporting arm with two upper supports, the invention provides an upwardly directed limb of the lower support, which limb is divided into two struts and merges by means of the latter into upwardly directed limbs of the upper supports. Such a transition of the lower support into the upper supports changes a torsional rigidity of the seat element and is suitable for a single-piece design of the supporting arm.

The invention also makes provision, in the case of a supporting arm with two upper supports, to guide the upper supports on the lower support or on the underframe by means of a respective guide element. The use of two guide elements enables the divided upper support also to be guided along a desired curve.

According to the invention, the front seat part can be raised by deformation of the supporting arm, which is necessitated by an individual leaning back against the backrest part, along a path in the direction of the backrest part, with the supporting arm deformed in such a manner resuming its original shape by load alleviation of the backrest part, and with the front seat part being lowered again along the path mentioned during the re-forming. The lowering of the front seat part makes it easier for the individual to return into an upright sitting position.

Finally, the invention makes provision to connect the upper support and the lower support of the supporting arm in the region of the lower backrest part by at least one connecting link and to connect them in the region of the rear seat part by at least one connecting link. By this means, buckling of the supports during the deformation between the basic position I and the resting position II can be effectively prevented.

In particular, it is also provided to connect a central section of the upper support of the supporting arm and a central section of the lower support of the supporting arm to each other by at least three connecting links. By this means, the forces occurring during the deformation of the supporting arm between the basic position I and the resting position II can be distributed particularly uniformly to the supports. This distribution of the load leads to an increase of the service life of the supporting arm.

Further details of the invention are described in the drawing with reference to schematically illustrated exemplary embodiments.

BRIEF DESCRIPTION OF THE DRAWINGS

In this case:

FIGS. 1*a* to 20 show schematic diagrams of eleven variant embodiments of a seat according to the invention.

DETAILED DESCRIPTION OF THE DRAWINGS AND THE PRESENTLY PREFERRED EMBODIMENTS

Figure 1B:
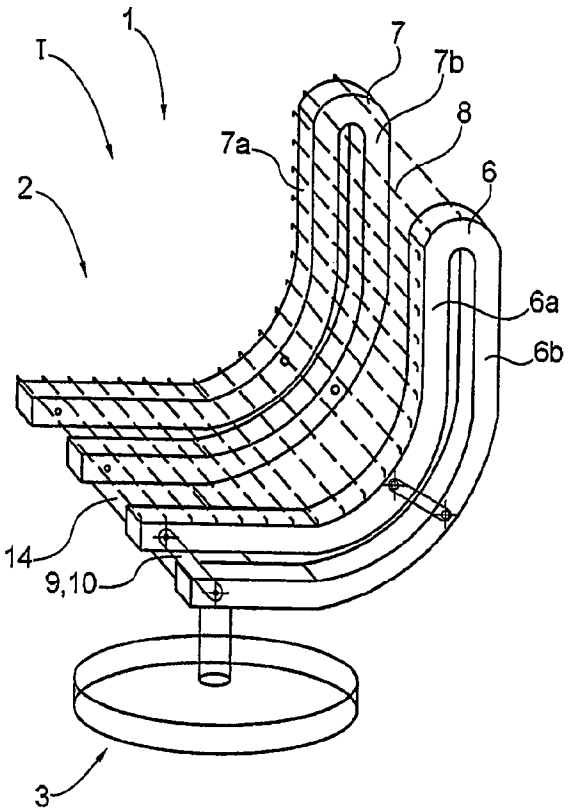
FIG. 1*b* shows: a perspective schematic diagram of the seat shown in FIG. 1*a;*
Figure 1A:
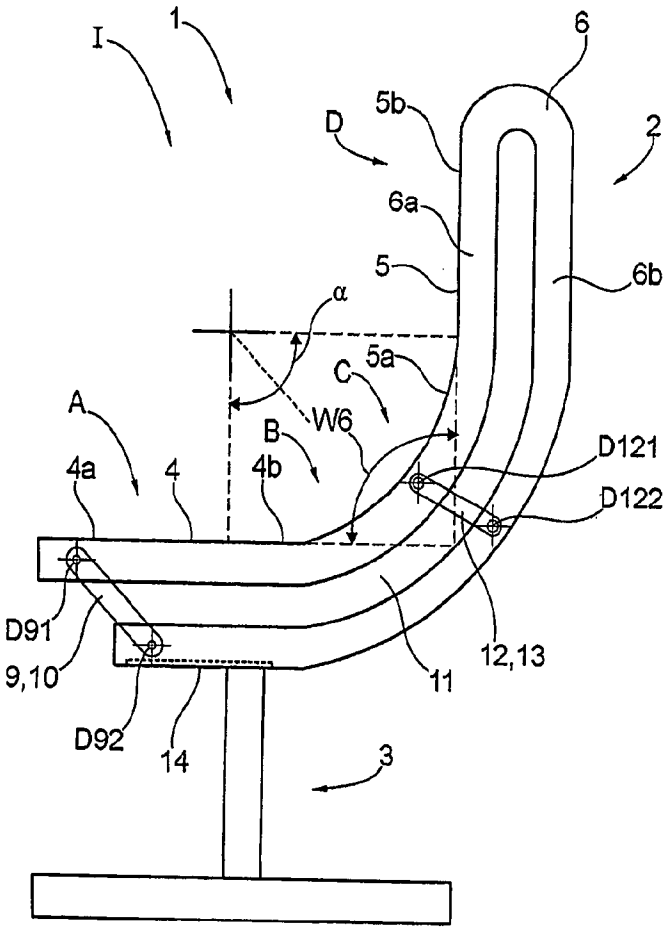
FIG. 1*a* shows: a simplified side view of a first variant embodiment of a seat according to the invention in a basic position I.

FIG. 1*a* illustrates a seat 1 in side view. The seat 1 includes a seat element 2 and an underframe 3. The seat element 2 has a seat part 4 which is divided into a front seat part 4*a* and a rear seat part 4*b*. Furthermore, the seat element 2 has a backrest part 5 which is divided into a lower backrest part 5*a* and an upper backrest part 5*b*. The seat element 2 includes two supporting arms 6, 7 which are each formed by an upper support 6*a* or 7*a* and a lower support 6*b*, 7*b* (also see FIG. 1*b*). A fabric 8, which is only visible in FIG. 1*b*, is stretched between the two supporting arms 6, 7 and the upper supports 6*a*, 7*a* thereof. Other body support components, such as a shell or membrane, alone or in combination with the fabric, can also bridge between the two supporting arms. FIG. 1*b* shows a simplified perspective view of the seat 1 illustrated in FIG. 1. For simplification, the seat 1 is described in more detail below only in the region of the first supporting arm 6. The upper support 6*a* is connected in a region A of the front seat part 4*a* to the lower support 6*b* by a guide element 9. The guide element 9 is designed as a lever 10 which is connected rotatably at pivotal points D91 and D92 to the upper support 6*a* and the lower support 6*b*. The second supporting arm 7 is in each case of corresponding design. The supports 6*a*, 6*b* of the supporting arm 6 merge into each other as a single part in a region D of the upper backrest part 5*b* and, according to a variant embodiment (not illustrated), are screwed or riveted to each other. From the region D, the supports 6*a*, 6*b* have an intermediate space 11 with respect to each other over their entire extent. In particular in a region B of the rear seat part 4*b* and in a region C of the lower backrest part 5*a*, the supports 6*a*, 6*b* run in an arcuately curved manner and approximately at the same distance from each other. In this curved region B or C, the two supports 6*a*, 6*b* are connected to each other by a connecting link 12. The connecting link 12 is designed as a lever 13 which is fastened rotatably to the supports 6*a* and 6*b* at pivotal points D121 and D122. The underframe 3 has a transverse support 14 to which the right and the left supporting arms 6, 7 of the seat element 2, and in particular the lower seat support are fastened. In particular, the lower seat support is fixedly connected to the support 14. FIGS. 1*a* and 1*b* both show the seat 1 in a basic position I in which the seat 1 is upright, if it is unloaded or if an individual is sitting on the seat 1 and is not leaning or is only slightly leaning against the backrest part 5.

In one embodiment, the upper support 6*a*, 7*a* has a cross sectional area of 1 $inch^3$ and a moment of inertia of 0.005000 $inch^4$ in the sections B and C. In various exemplary and suitable embodiments, the cross sectional area can be from 0.3 $inch^2$ to 4 $inch^2$ and the moment of inertia can be from 0.000172 $inch^4$ to 0.011442 $inch^4$. Preferably, the cross-sectional area is at least 0.3 $inch^2$ and the moment of inertia is at least 0.000172 $inch^4$. In one embodiment, the connecting links are spaced apart about 3 inches. In various exemplary embodiments, the connecting links are spaced at least 0.5 inch, but preferably no more than 8 inches. In the section A the moment of inertia of the first upper support 6*a*, 7*a* increases in direction to front seat part 4*a* in comparison with the moment of inertia in the sections B and C. In the section D the moment of inertia of the upper support 6*a*, 7*a* is comparable with the moment of inertia of the upper support 6*a*, 7*a* in the sections B and C. In all sections A, B, C and D the lower support 6*b*, 7*b* is dimensioned comparably to the corresponding section of the upper support 6*a*, 7*a*. In various exemplary embodiments, the values for the moment of inertia and cross sectional areas differ from the values of the upper support 6*a*, 7*a* by a factor from 0.5 to 1.5. Preferably the upper and lower support 6*a*, 7*a*, 6*b*, 7*b* have a cross sectional area of the same shape. According to the embodiment of FIGS. 1*a* and 1*b* the cross sectional area has the shape of a rectangle. In various exemplary and suitable embodiments, the cross sectional area of the supports 6*a*, 7*a*, 6*b*, 7*b* has the shape of a circle or an oval or a polygon.

The supports can be made, for example and without limitation, of glass filled Nylon, unfilled Nylon, glass filled polypropylene, unfilled polypropylene, polycarbonate, polycarbonate/ABS blend, acetal, or combinations thereof. The connecting links and/or the levers can be made of the same materials, or of various elastomeric materials, including without limitation, Hytrel, Nylon blended with elastomers, thermoplastic urethane or combinations thereof. The connecting links and/or the levers can also be made of rigid materials, including various rigid plastics or metal.

Figure 2:
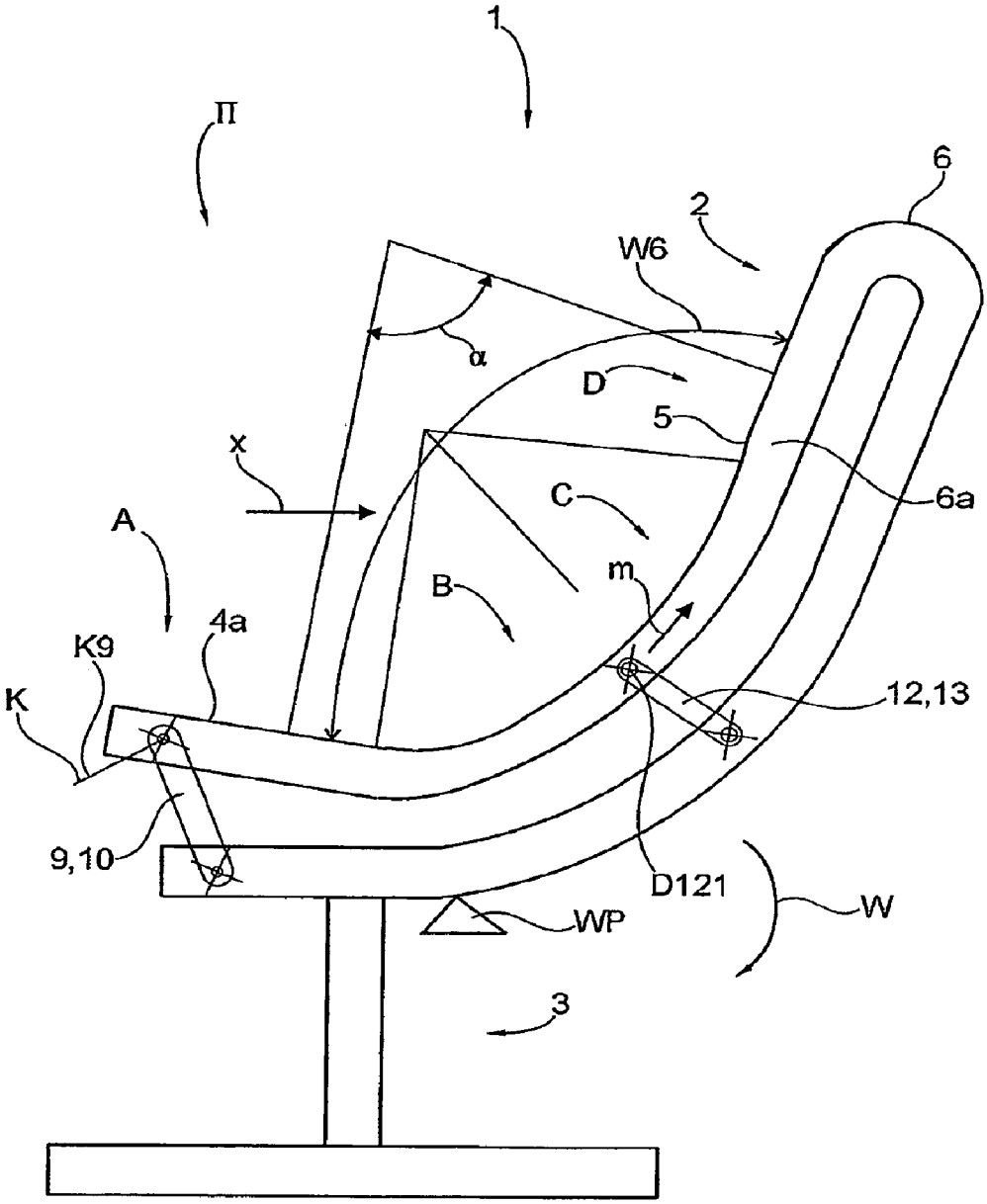
FIG. 2 shows: the seat shown in FIG. 1*a* in a resting position II.

FIG. 2 illustrates the seat 1 known from FIGS. 1*a* and 1*b* in a resting position II. The seat 1 or the seat element 2 takes up a resting position II of this type if an individual sitting on the seat 1 leans back in an arrow direction x against the backrest part 5. The action of leaning back changes an inner opening angle $\alpha$ of the seat element 2 between the seat part 4 and the backrest part 5 from $\alpha$=90° (see FIG. 1*a*) to $\alpha$=80° (see FIG. 2). This change in the inner opening angle $\alpha$ is produced by the supporting arm 6 being bent, which takes place essentially in the regions B and C and at the transition of the region B into the region A, and by the front seat part 4*a* being raised or inclined. An opening angle W6 relevant to the sitting comfort therefore increases from the basic position I into the resting position II by 10° from W6=90° to W6=100°. By the supporting arm 6 being bent, the upper support 6*a* thereof is pulled, in particular in the region A, in the arrow direction x. This leads, because of the guide element 9, to the front seat part 4*a* being raised or inclined. Said seat part can only move out of the basic position I, shown in FIG. 1*a*, on an arcuate path K9 which is predefined by the guide element 9 and is designed as a circular path K. In other words, the seat element 2 tips or sways or rocks about a rocking point WP in a manner similar to the beam of a beam-balance, with the two supporting arms 6 of the seat element 2 being deformed in the process as a function of their particular position. In the resting position II, not only has an orientation of the guide element 9, which is designed as a lever 10, but also an orientation of the mechanical connecting link 12, which is designed as a lever 13, then changed. When the supporting arm 6 is bent up, the upper support 6*a* thereof is forced to describe a relatively large radius. However, this is only possible if the upper support 6*a* with the pivotal point D121 for the lever 13 moves approximately in a direction m. The movement of the pivotal point D121 is predefined by the coupling of the upper support 6*a* to the lower support 6*b* by the mechanical connecting link 12 in order to prevent buckling or to obtain a defined movement. By means of the described active movement or deformation of the seat element 2 or of the front seat part 4*a*, an individual sitting on the seat 1 is slightly raised in the region of his thighs as he leans back. This facilitates reaching the basic position I from the resting position II without energy having to be stored to a considerable extent in a spring element. The points of application of the weight of an individual sitting on the seat are therefore changed between the basic position I and the resting position II in order to obtain, as a function of the position of the seat element 2, a position which is oriented to an equilibrium. This makes it largely superfluous, during the leaning-back action, to store potential energy of the upper body in a force store, such as, for example, a spring, since the potential energy of the upper body of an individual is supplied by the kinematics of the seat element to the lower body of the individual as potential energy. For this reason, with the seat according to the invention similar sitting comfort is basically possible even for individuals of very different body weight without a spring having to be adjusted to the weight of the particular individual.

Figure 3:
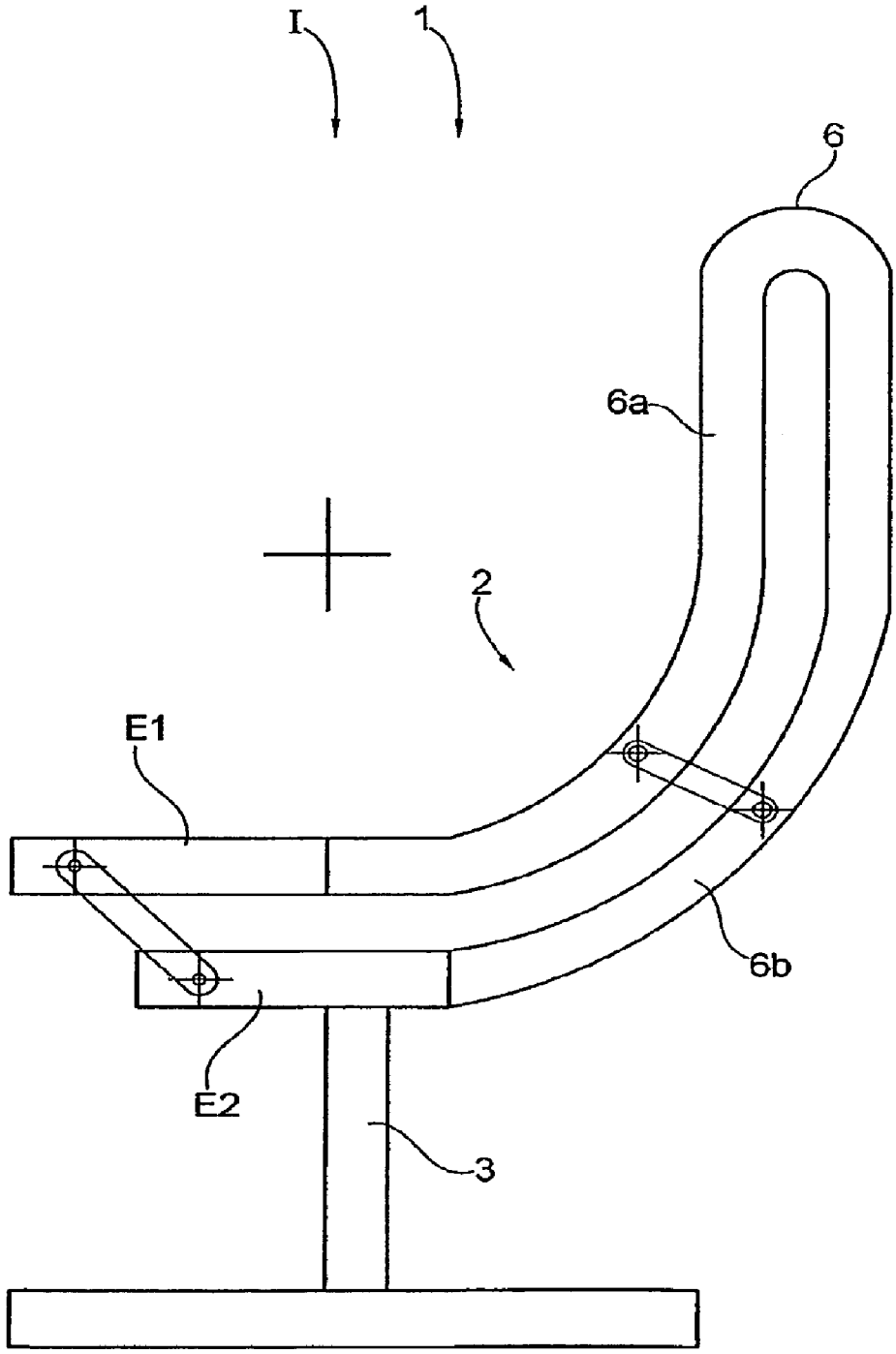
FIG. 3 shows: a second variant embodiment of a seat according to the invention in a basic position.
Figure 4:
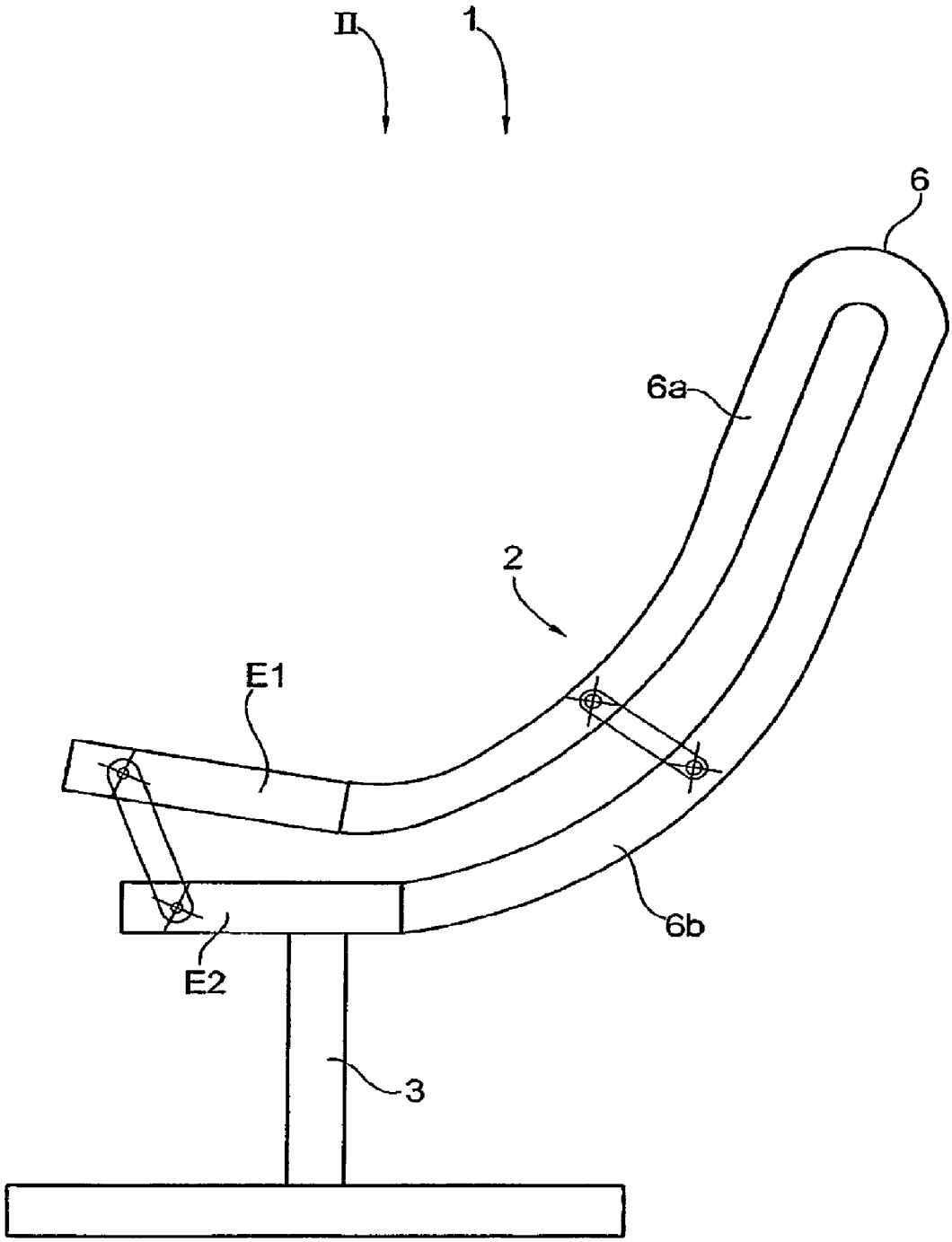
FIG. 4 shows: the seat shown in FIG. 3 in a resting position II.

FIGS. 3 and 4 show a second variant embodiment of a seat 1 according to the invention in a basic position I and in a basic position II. Like the first variant embodiment, the second variant embodiment of the seat 1 has two supporting arms 6, the second supporting arm being concealed in the side view. In contrast to the first variant embodiment, in the second variant embodiment a right supporting arm 6 and a left supporting arm are of rigid design at free ends E1, E2 of their supports 6*a*, 6*b*. The free end E2 of the lower support 6*b* therefore behaves, in principle, as an underframe 3, and an elastic region of the lower support 6*b* is of shortened design in comparison to the first variant embodiment (see FIGS. 1*a* to 2).

Figure 5:
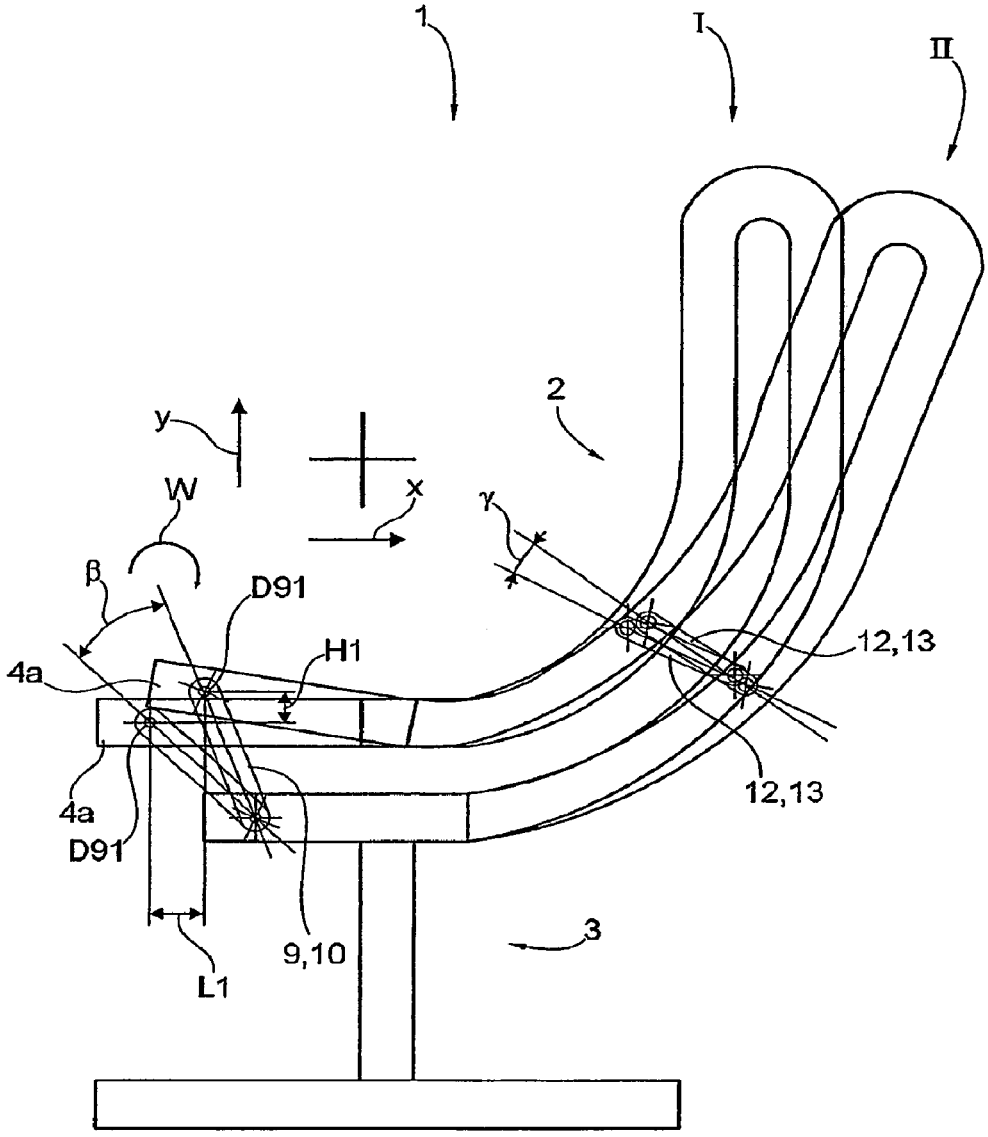
FIG. 5 shows: a superimposed illustration of the illustrations shown in FIGS. 3 and 4.

In FIG. 5, the illustrations of FIGS. 3 and 4 are shown superimposed. This illustration reveals how a guide element 9, which is designed as a lever 10, rotates by an angle $\beta=25°$ in an arrow direction w between the basic position I and the resting position II. By this means, a front seat part 4*a* is raised at its pivotal point D91 by a height H1 in an arrow direction y and is pushed rearwards by a distance L1 in an arrow direction x. A connecting link 12, which is designed as a lever 13, also rotates in the direction of rotation w, changes its angle by $\gamma=10°$ and drops slightly.

Figure 6:
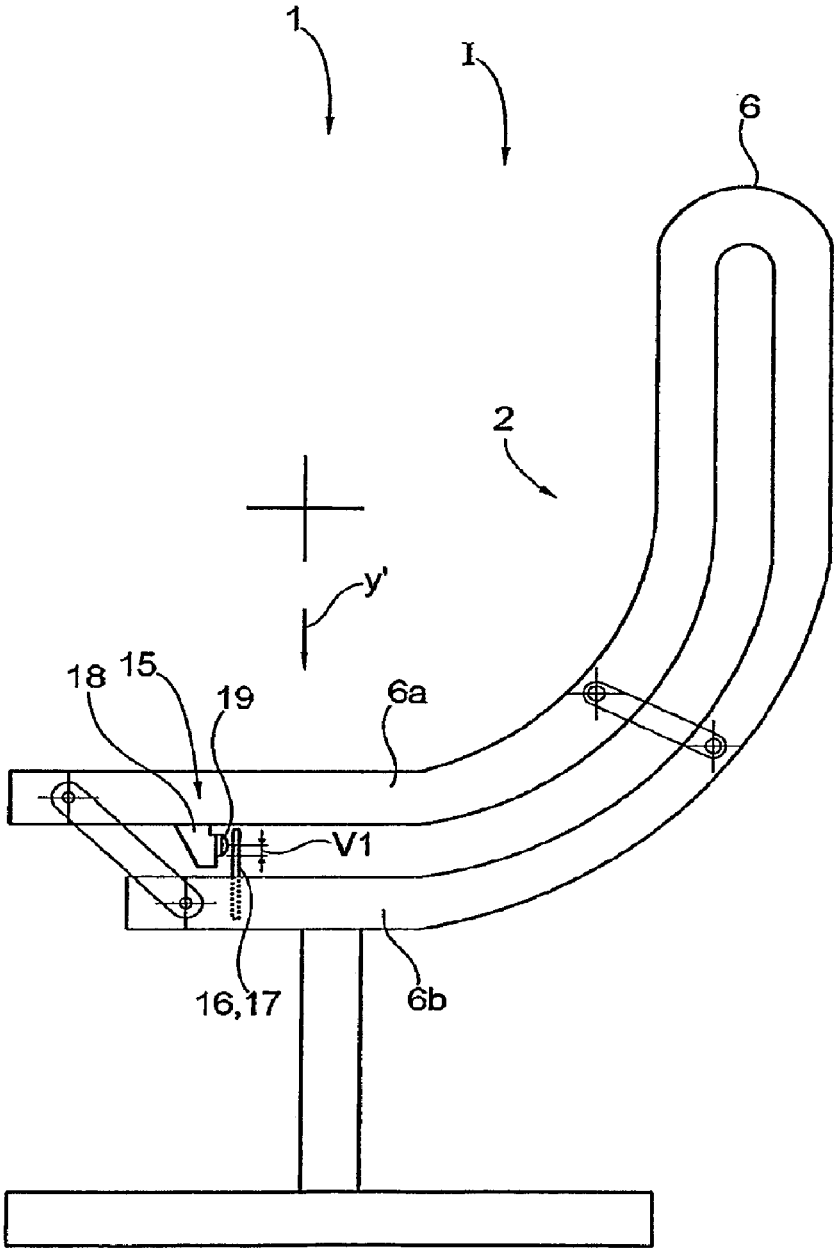
FIG. 6 shows: a third variant embodiment of a seat according to the invention in a basic position.

FIG. 6 illustrates, as an analogy with FIG. 1*a*, a third variant embodiment of a seat 1 according to the invention with a seat element 2 in a basic position I. The description for FIGS. 1*a* to 2 basically applies to this seat 1. In addition, the seat 1 of FIG. 6 has an energy store or force store 15 which comprises a leaf spring 17 as the spring element 16. The leaf spring 17 is fastened in a lower support 6*b* of a first supporting arm 6 and stands in the way of a stop 18 belonging to the energy store 15. The stop 18 is fastened to an upper support 6*a* of the supporting arm 6. As soon as the seat element 2 moves from the illustrated basic position I into a resting position (not illustrated here) according to FIG. 2, the stop 18 presses against the leaf spring 17. By this means, the energy store 15 damps the movement of the support 6*a* and assists a return movement into the basic position I. By displacement of a contact body 19 of the stop 18 in an arrow direction y' by, for example, a displacement distance V1, a resetting force produced by the energy store 15 can be adjusted. The embodiment of a corresponding energy store is provided on a left supporting arm of the seat 1, which supporting arm is not visible in the illustration of FIG. 6.

Figure 7:
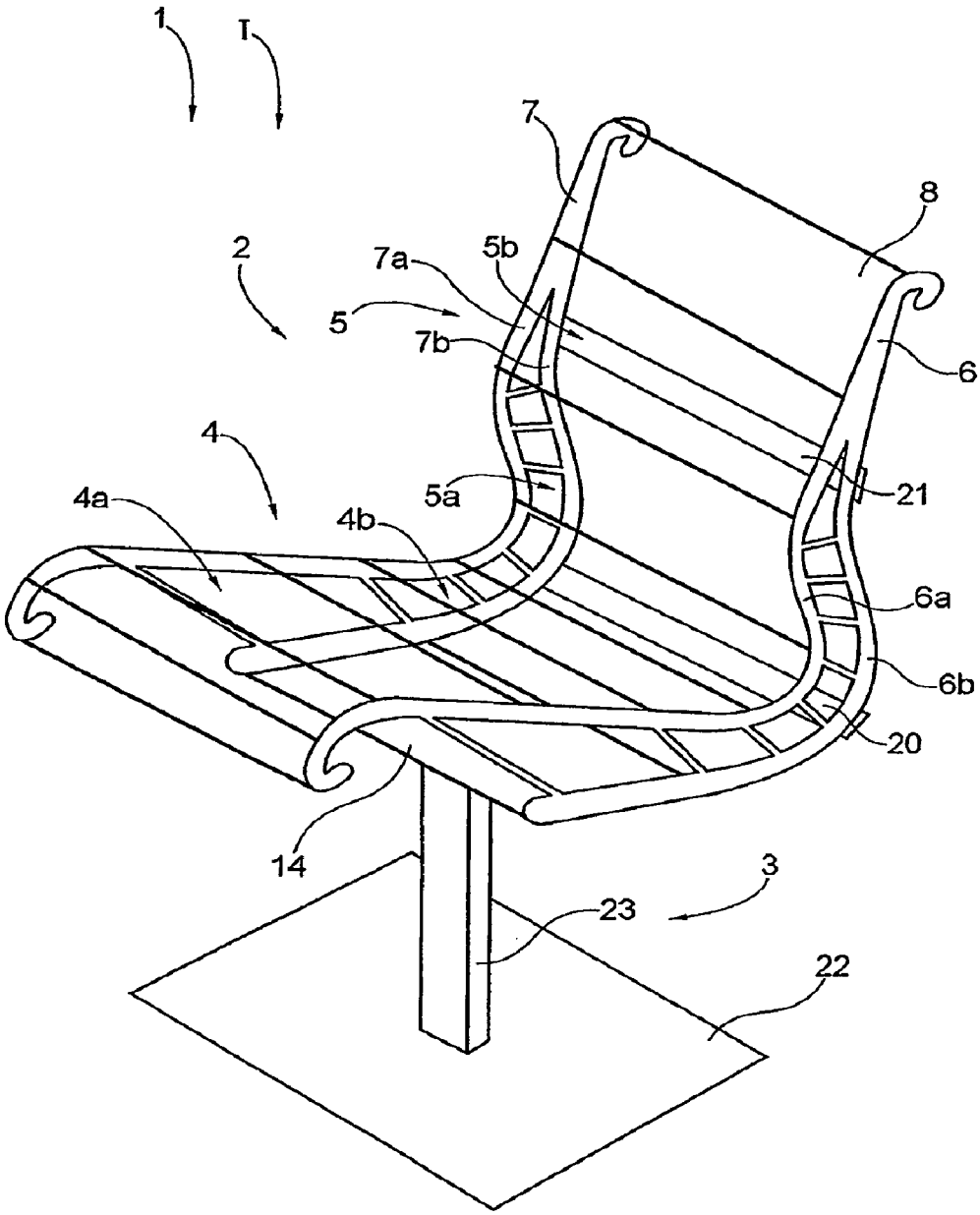
FIG. 7 shows: a simplified perspective illustration of a fourth variant embodiment of a seat according to the invention.

FIG. 7 illustrates a fourth variant embodiment of a seat 1 in a simplified perspective view. The seat 1 includes a seat element 2 and an underframe 3. The seat element 2 has a seat part 4 which is divided into a front seat part 4*a* and a rear seat part 4*b*. Furthermore, the seat element 2 has a backrest part 5 which is divided into a lower backrest part 5*a* and an upper backrest part 5*b*. The seat element 2 comprises two supporting arms 6, 7 which are each formed by an upper support 6*a* or 7*a* and a lower support 6*b*, 7*b*. A fabric 8, or other body support structure, is stretched between the two supporting arms 6, 7 or the upper supports 6*a*, 7*a* thereof. The seat element 2 is fastened on a transverse support 14 of the underframe 3 by the lower supports 6*b*, 7*b*. The supporting elements 6, 7 or the lower supports 6*b*, 7*b* thereof are furthermore connected to each other via two transverse struts 20, 21 in order to couple the supporting elements 6 and 7 to each other so that the latter can mutually support each other if the seat 1 is loaded on one side. In addition to the transverse support 14, the underframe 3 also comprises a footplate 22 which is connected to the transverse support 14 via a strut 23. The seat 1 is in a basic position I.

Figure 8:
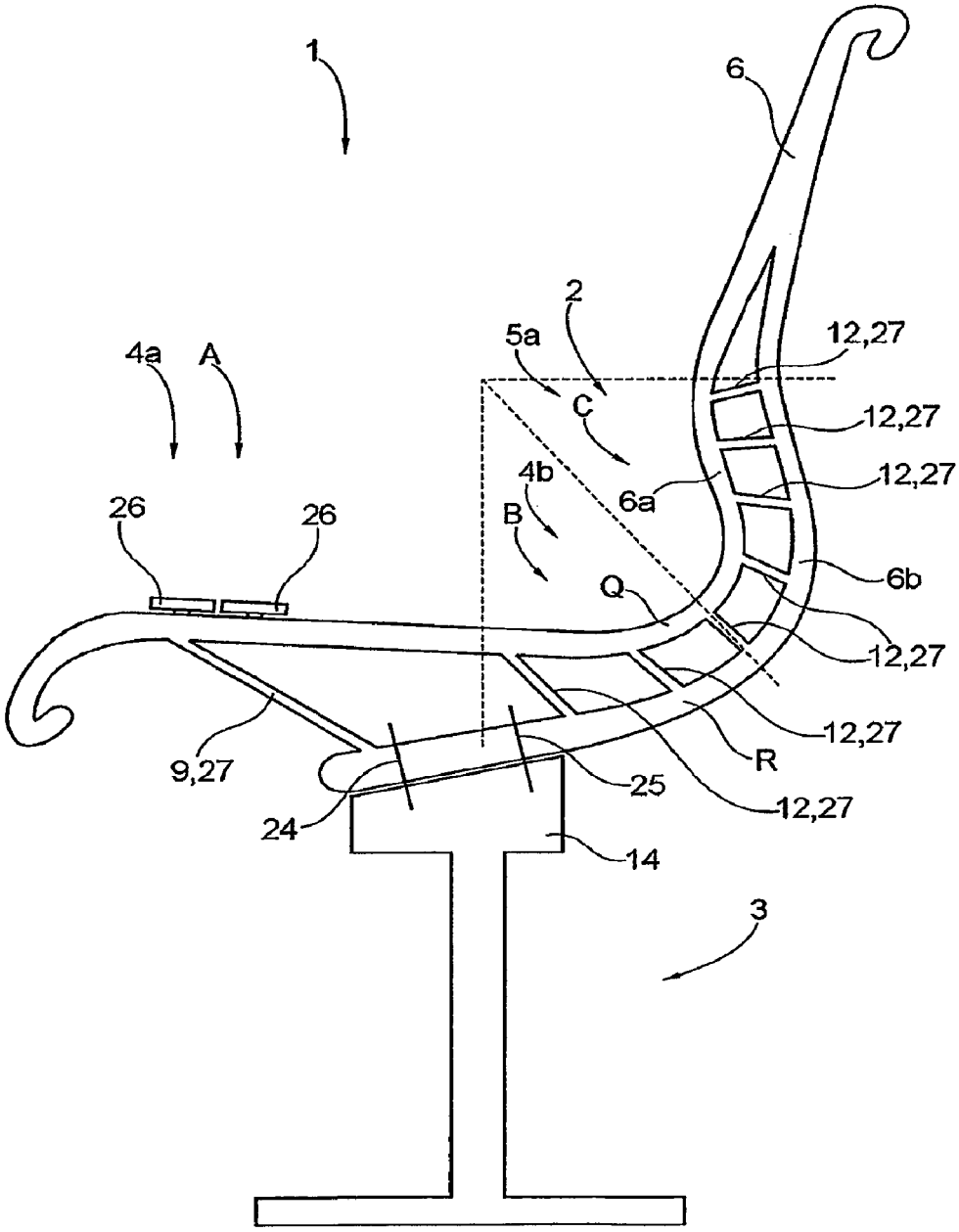
FIG. 8 shows: a simplified side view of a fifth variant embodiment of a seat according to the invention.

FIG. 8 illustrates a fifth variant embodiment of a seat 1 in a simplified side view. A seat element 2 is screwed here by lower supports 6*b* of two supporting arms 6 (only one supporting arm is visible in the side view) to a transverse support 14 of an underframe 3 at two fastening points 24, 25. The lower support 6*b* and an upper support 6*a* of the supporting arm 6 are connected in a region A of a front seat part 4*a* via a guide element 9. The guide element 9 is integrally formed as a single piece with the upper support 6*a* and the lower support 6*b* of the supporting arm 6. In a region B of a rear seat part 4*b* and a region C of a lower backrest part 5*a*, the upper support 6*a* and the lower support 6*b* are connected to each other by seven connecting links 12 which are likewise integrally formed as a single piece with said supports. The upper support 6*a* is formed in the regions B and C by a central section Q, and the lower support 6*b* is formed in the regions B and C by a central section R. Instead of a fabric, in this embodiment the upper supports 6*a* of the two supporting arms 6 bear a multiplicity of transverse slats 26 which connect the two supports 6*a*. It should be understood that a fabric, or other body support member, is also suitably employed. Only two transverse slats are illustrated by way of example. The guide element 9 and the connecting links 12 are designed as spokes 27 and the latter, like the upper and the lower support 6*a*, 6*b*, are made from plastic. The seat 1 is in a basic position I.

Figure 9:
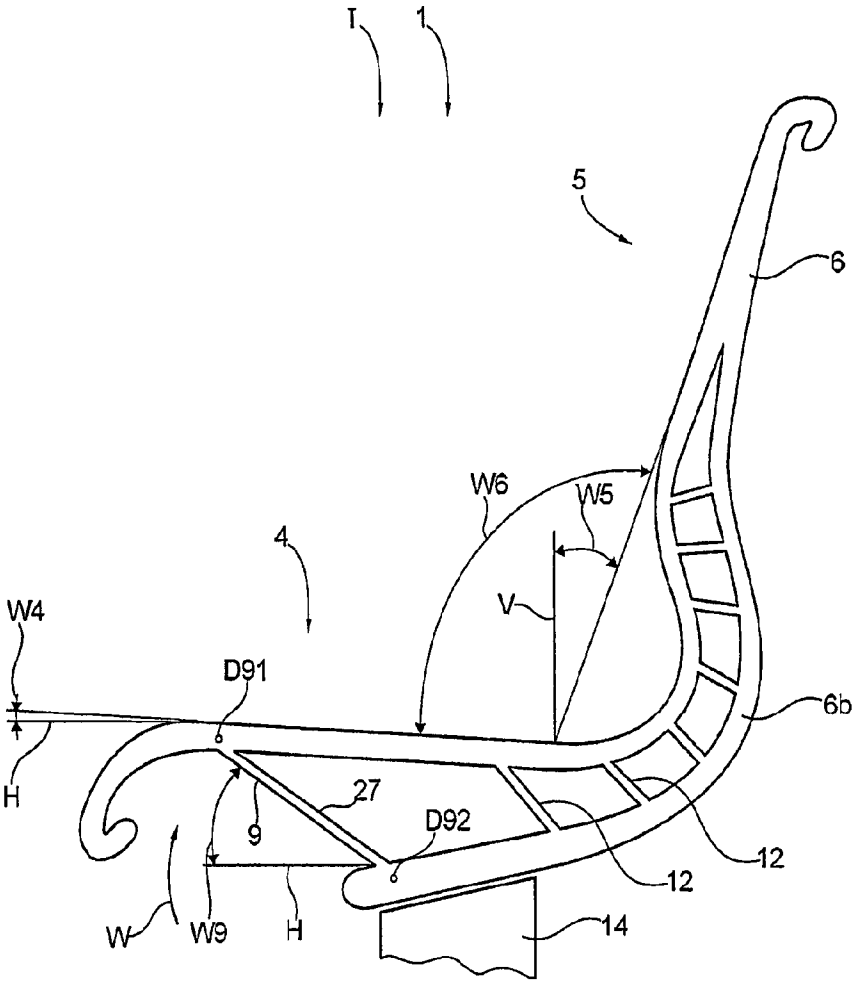
FIG. 9 shows: an enlarged illustration of the supporting element of the seat, shown in FIG. 8, in a basic position.
Figure 10:
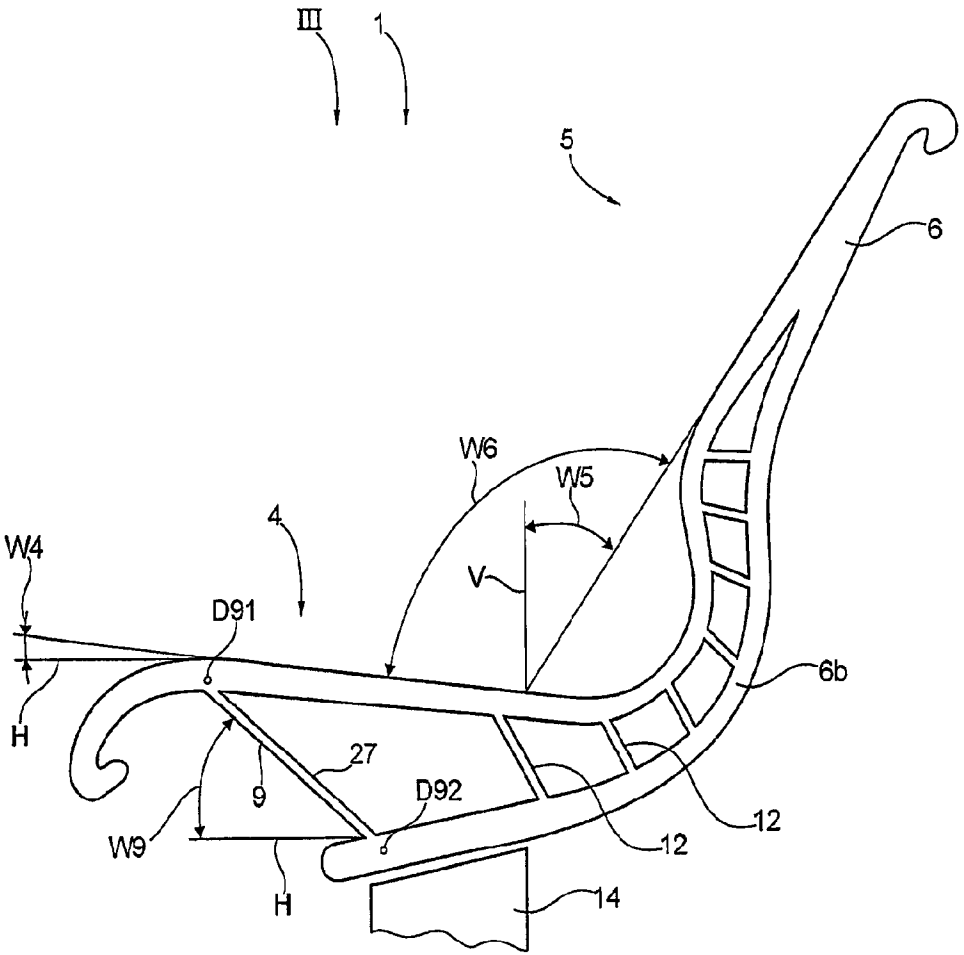
FIG. 10 shows: an enlarged illustration of the supporting element of the seat, shown in FIG. 8, in an intermediate position.
Figure 11:
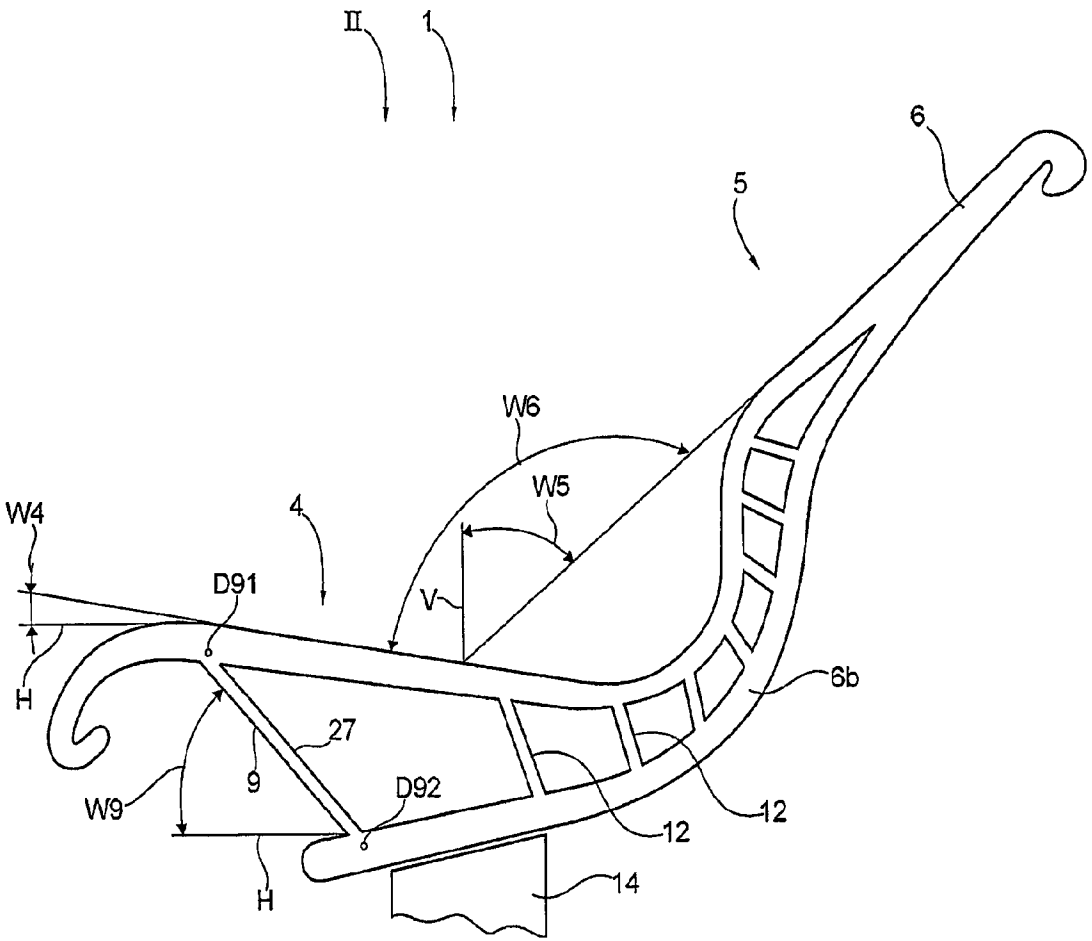
FIG. 11 shows: an enlarged illustration of the supporting element of the seat, shown in FIG. 8, in a resting position.

FIGS. 9, 10 and 11 exclusively illustrate the supporting arm 6 and part of the transverse support 14 of the seat 1 shown in FIG. 8. FIG. 9 shows the supporting arm 6 in the basic position I, FIG. 11 shows the supporting arm 6 in a resting position II, and FIG. 10 shows the supporting arm 6 in an intermediate position III located between the basic position I and the resting position II. In the three positions I-III illustrated, the following values then arise for an opening angle W6 between seat part 4 and backrest part 5, for an angle W4 between the seat part 4 and a horizontal H, for an angle W5 between the backrest part 5 and a vertical V, and for an angle W9 taken up by the guide element 9 with respect to a further horizontal H:

| | W6 | W4 | W5 | W9 |
|---|---|---|---|---|
| I - BASIC POSITION | 105 | 2 | 18 | 32 |
| III - INTERMEDIATE POSITION | 118 | 6 | 33 | 40 |
| II - RESTING POSITION | 130 | 8 | 48 | 46 |

Figure 12:
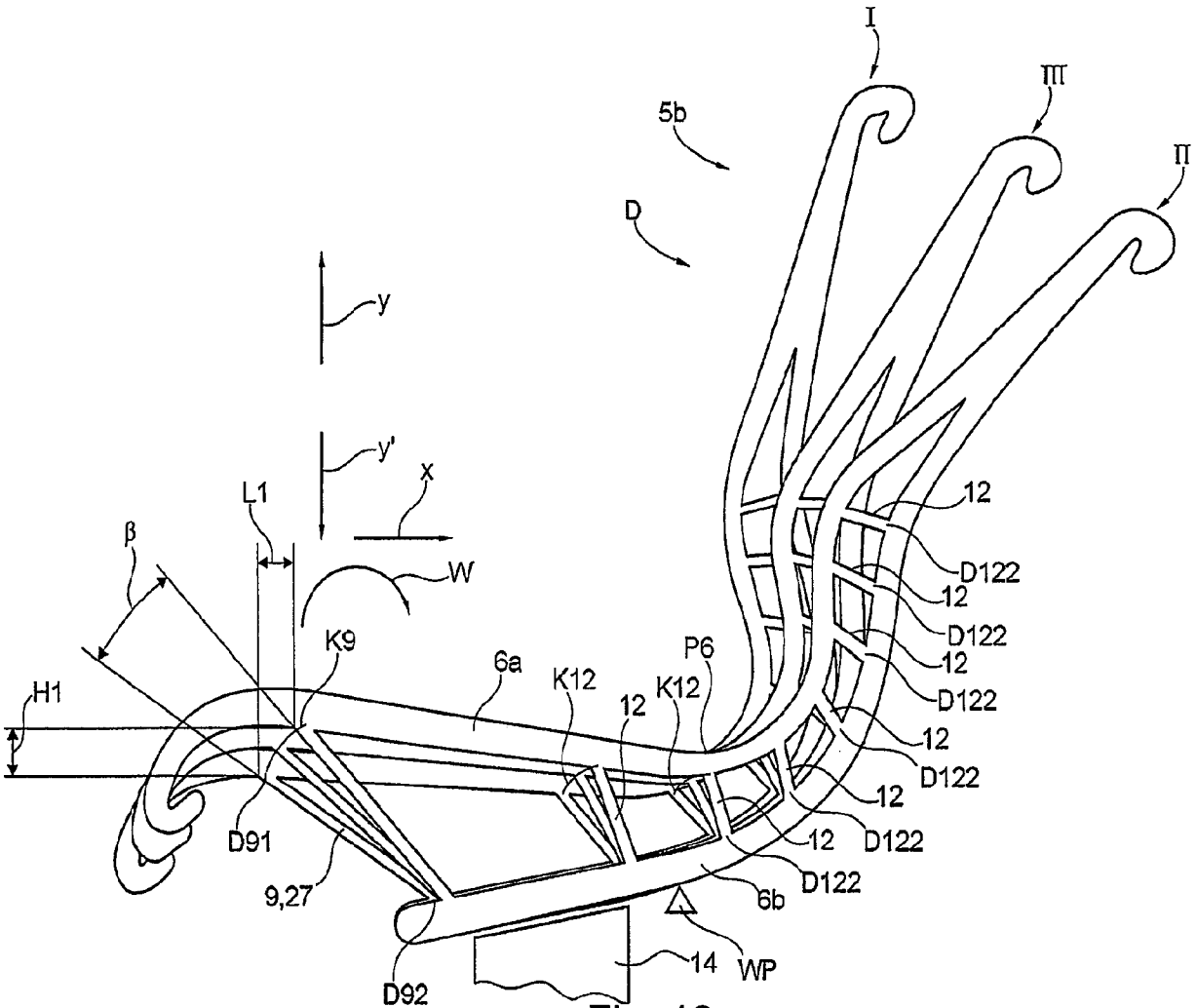
FIG. 12 shows: a superimposed illustration of the positions, shown in FIGS. 9 to 11, of the supporting element.

The guide element 9 rotates about a pivotal point or elastic region D92 from the basic position I in the clockwise direction in a direction of rotation w into the resting position II (compare FIGS. 9 and 11). In this connection, the guide element 9, which is designed as a spoke 27, is situated in all possible positions between 9 o'clock and 12 o'clock between the basic position I and the resting position II. The angle W9 taken up in this case by the guide element 9 changes from 32° to 46° and therefore increases by β=14° (also see FIG. 12). During the rotation, the guide element 9 raises the upper support 6*a* or the region A of the front seat part 4*a* at a pivotal point or elastic region D91. In the elastic region D91, the guide element 9 merges into the upper support 6*a*. Upon rotation of the elastic region 91 on an arcuate path K9, the region A is raised upwards by a distance H1 in an arrow direction y and is displaced to the right by a distance L1 in an arrow direction x (see FIG. 12). This movement can be described by a type of rocking movement of the supporting arm 6 at a rocking point or rocking region WP. The rocking region here is arranged approximately wherever the lower support 6*b* of the supporting arm 6 leaves the transverse support 14 as a cantilever or wherever elastic deformation of the lower support 6*b* is possible. The supporting arm 6 is bent up in particular as a result of loading of a region D of an upper backrest part 5*b*. The upper support 6*a* here, as it is bent up from the lower support 6*b*, is pulled rearwards and downwards in the arrow direction x and an arrow direction y'. During this bending-up movement, the upper support 6*a* is guided by the guide element 9 and by the connecting links 12 on the lower support 6*b* on a multiplicity of paths K9 and K12. As an individual leans back, this pulling-back action of the upper support 6*a* causes the upper support 6*a* to be raised on the left from a point P6 and causes the upper support 6*a* to be lowered on the right from the point P6. Therefore, during the movement into the position II, the seat part 4 is raised and, at the same time, the backrest part 5 is lowered. During the transition from the basic position I into the resting position II, the connecting links 12 all rotate to the right in the arrow direction w about pivotal points or elastic regions D112 on the lower support 6*b*. In the process, the elastic regions D112 also change their position by the lower support 6*b* being bent up.

Figure 13:
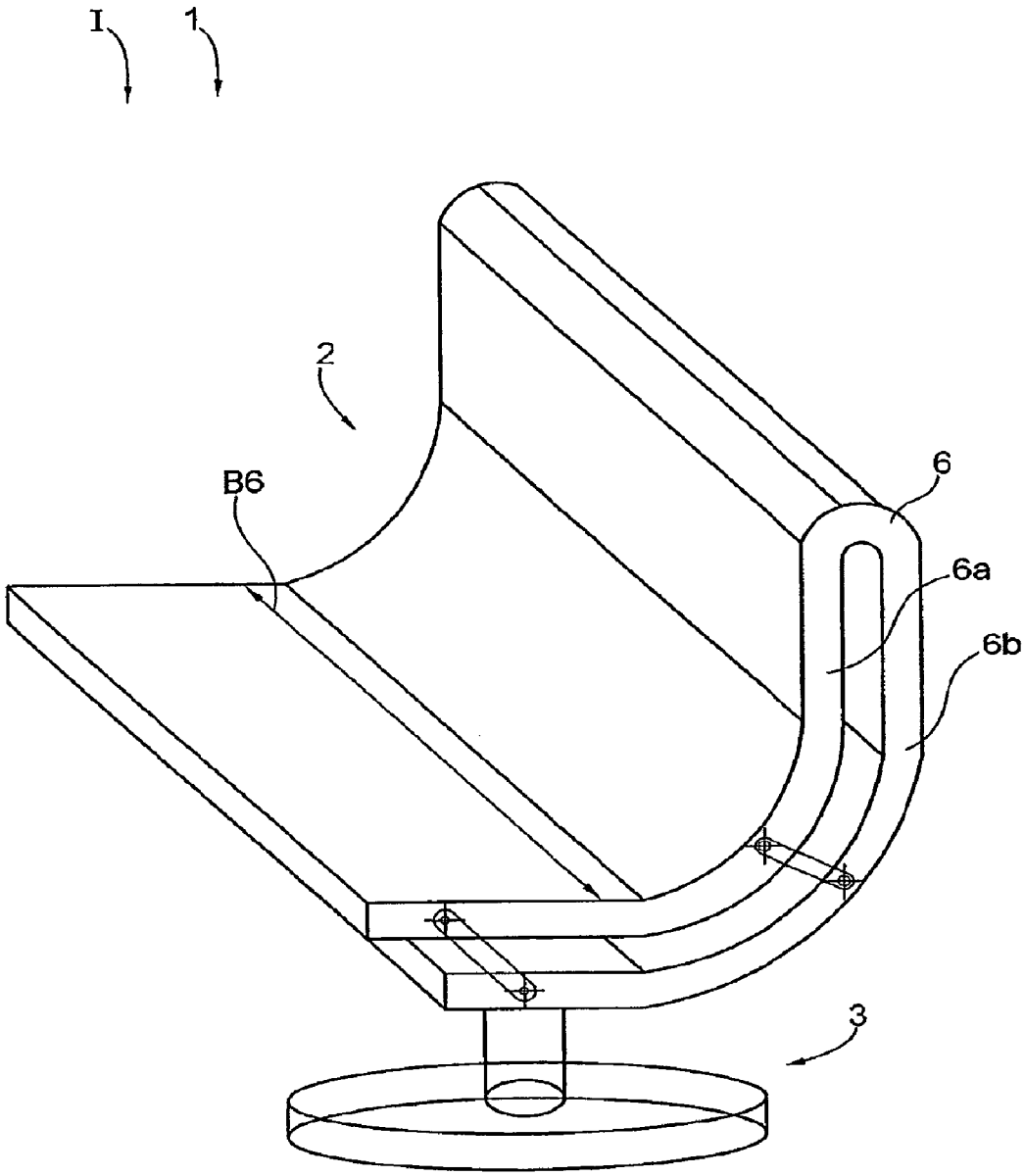
FIG. 13 shows: a simplified perspective view of a sixth variant embodiment of a seat according to the invention.

FIG. 13 illustrates a sixth variant embodiment of a seat 1 according to the invention in a simplified perspective view. A seat element 2 is essentially formed solely by a supporting arm 6 with supports 6*a* and 6*b*. For this purpose, the supporting arm 6 has a width B6 required for the seat element 2. The lower support 6*b* is fastened on an underframe 3 of the seat 1. The seat 1 or the seat element 2 is in a basic position I.

Figure 14:
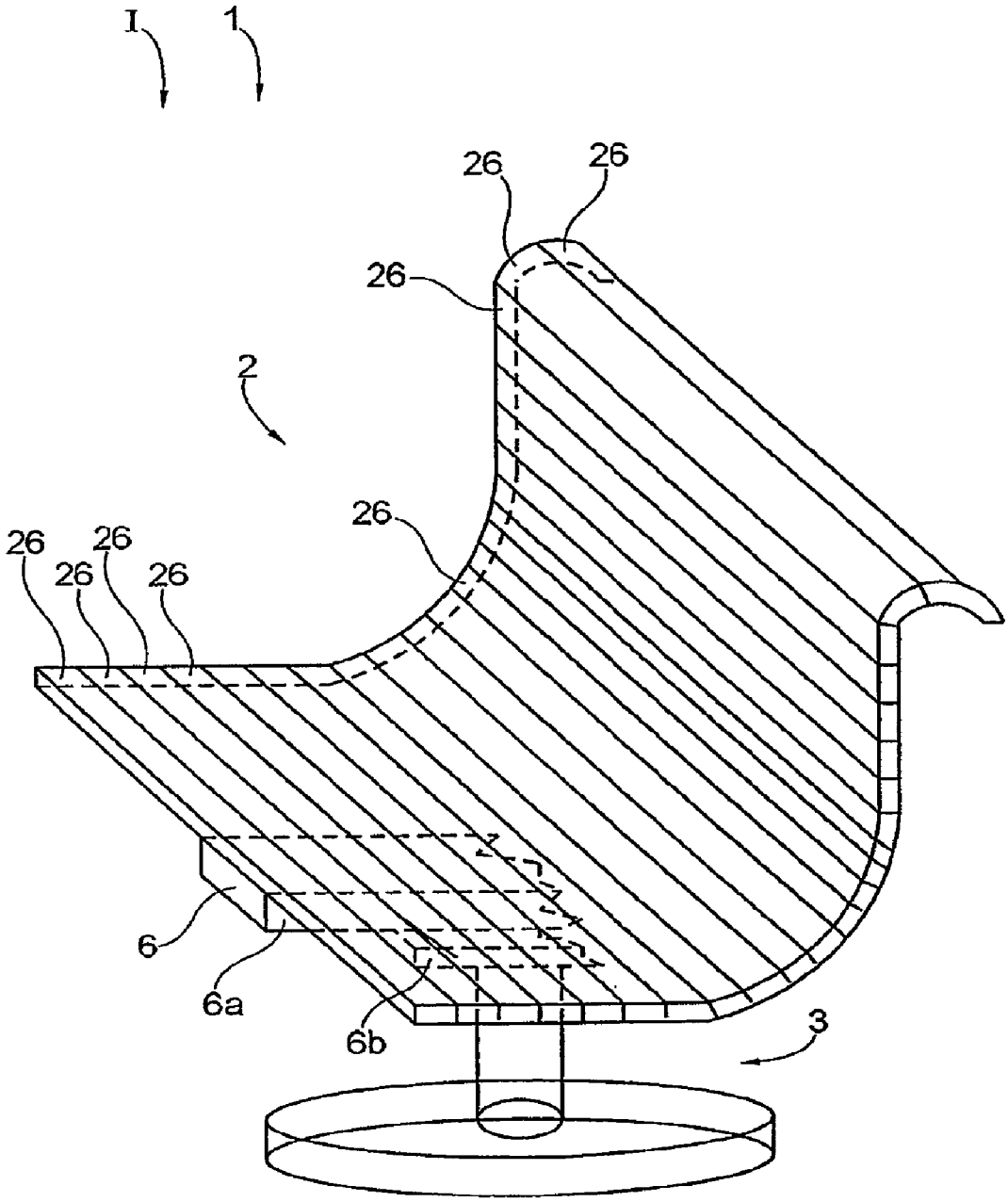
FIG. 14 shows: a simplified perspective view of a seventh variant embodiment of a seat according to the invention.

FIG. 14 illustrates a seventh variant embodiment of a seat 1 according to the invention in a simplified perspective view. A seat element 2 is essentially formed by a supporting arm 6 (only partially illustrated) with supports 6*a* and 6*b* and transverse slats 26. The transverse slats 26 are arranged on the upper support 6*a* of the supporting arm 6 and are movable in relation to one another in order not to inhibit or obstruct the deformation of the upper support 6*a*, which deformation arises as a basic position I illustrated is left. The lower support 6*b* is fastened on an underframe 3 of the seat 1.

Figure 15:
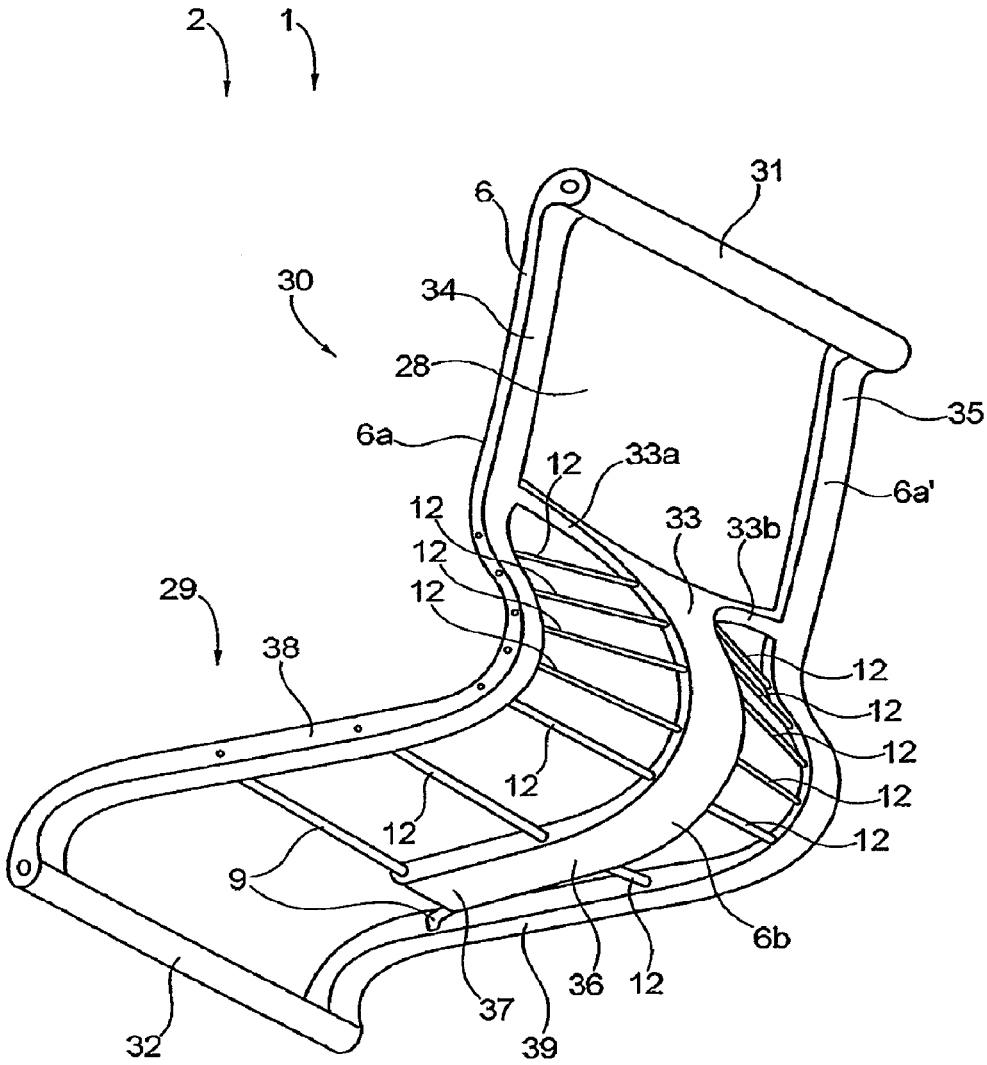
FIG. 15 shows: a perspective view of a seat element of an eighth variant embodiment of a seat according to the invention.

FIG. 15 illustrates a perspective view of a seat element 2 of an eighth variant embodiment of a seat 1. The seat element 2 has a supporting arm 6 which bears a covering 28 which forms a seat surface 29 and a backrest 30. The supporting arm 6 comprises a left, upper support 6*a*, a right, upper support 6*a*' and a lower support 6*b* located between them. The lower support 6*b* is connected to the left, upper support 6*a* by mechanical connecting links 12 and to the right, upper support 6*a*' by further mechanical connecting links 12. The upper supports 6*a* and 6*a*' are connected to each other by two transverse supports 31 and 32. An upwardly directed, approximately vertically situated limb 33 of the lower support 6*b* is divided into two struts 33*a*, 33*b* and merges with the latter into upwardly directed limbs 34, 35 of the upper supports 6*a*, 6*a*'. By this means, the upper supports 6*a* and 6*a*' and the lower support 6*b* form the single-part supporting arm 6. An approximately horizontally running limb 36 of the lower support 6*b* is connected at a free end 37 via a guide element 9 to an approximately horizontally running limb 38 of the left, upper support 6*a* and to an approximately horizontally running limb 39 of the right, upper support 6*a*'.

Figure 16:
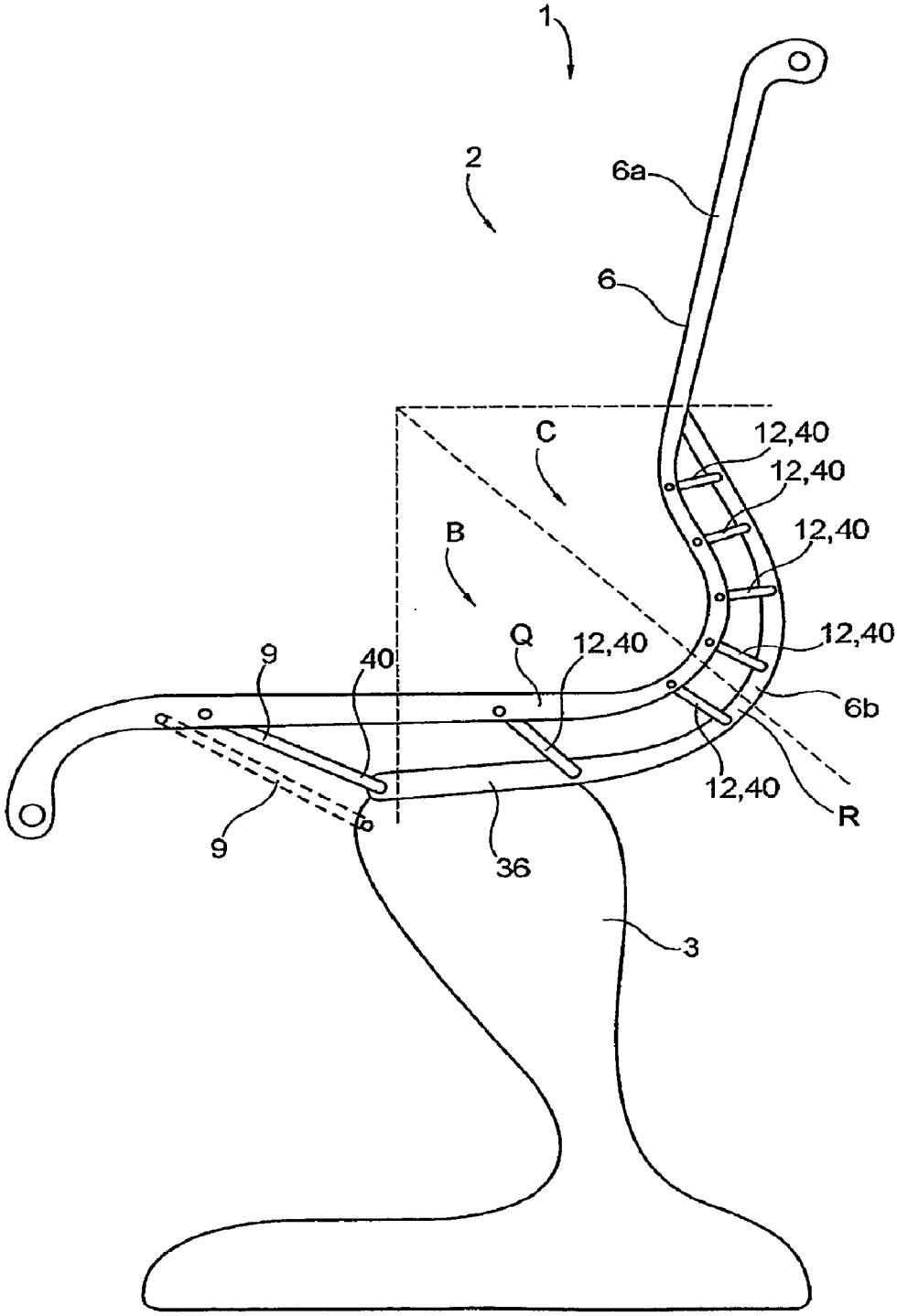
FIG. 16 shows: a side view of the eighth variant embodiment of the seat.

FIG. 16 shows a side view of the seat 1, the seat element 2 of which is already known from FIG. 15. The side view also illustrates an underframe 3 of the seat 1. The underframe 3 is connected to the limb 36 of the lower support 6*b*. Only the left, upper support 6*a* of the upper supports can be seen in the side view, the right, upper support is completely concealed. The supporting arm 6 which is of single-part design is connected between its upper support 6*a* and its lower support 6*b* via the guide element 9 and six connecting links 12. The guide element 9 and the connecting links 12 are designed as struts 40 which are mounted rotatably in the upper support 6*a* and the lower support 6*b*. A variant embodiment for the arrangement of the guide element 9, which arrangement replaces the guide element 9 (illustrated by solid lines), is illustrated by dashed lines. The guide element 9 shown by dashed lines connects the underframe 3 and the upper support 6*a*. A seat part 4 of the seat 1 is situated with a rear seat part 4*b* in a region B, and a backrest part 5 is situated with a lower backrest part 5*a* in a region C. In the regions B and C, the upper supports 6*a*, 6*a*' are formed by central sections Q and Q'. The lower support 6*b* is formed in these two regions B and C by a central section R. All six connecting links 12 visible in FIG. 16 are arranged between the central section Q of the upper support 6*a* and the central section R of the lower support 6*b*. A further six connecting links are arranged between the upper support 6*a*' and the lower support 6*b* (see FIG. 17).

Figure 17:
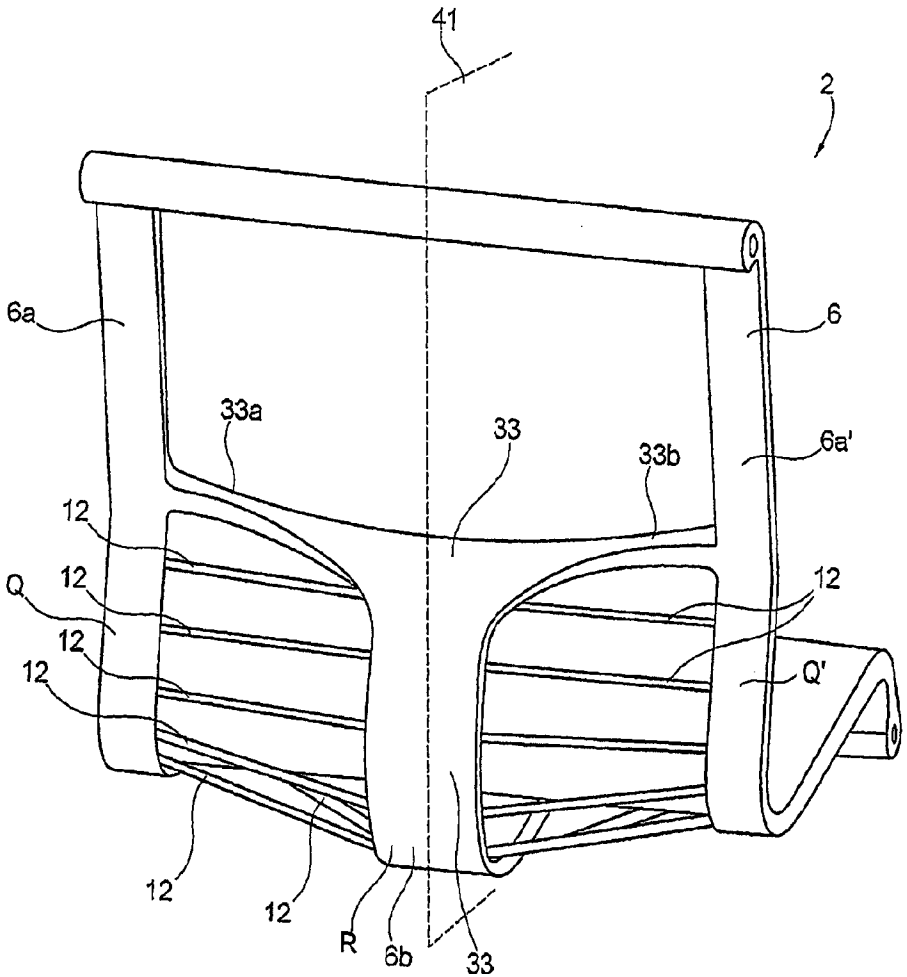
FIG. 17 shows: a further perspective view of the seat element known from FIG. 15, and FIGS. 18-20 show: side views of a ninth, tenth and eleventh variant embodiment of a seat according to the invention.

FIG. 17 illustrates, in a further perspective view, the seat element 2 shown in FIG. 15. It can be seen from this view that the seat element 2 or the supporting arm 6 is formed mirror-symmetrically with respect to a plane 41 situated vertically in space.

Figure 19:
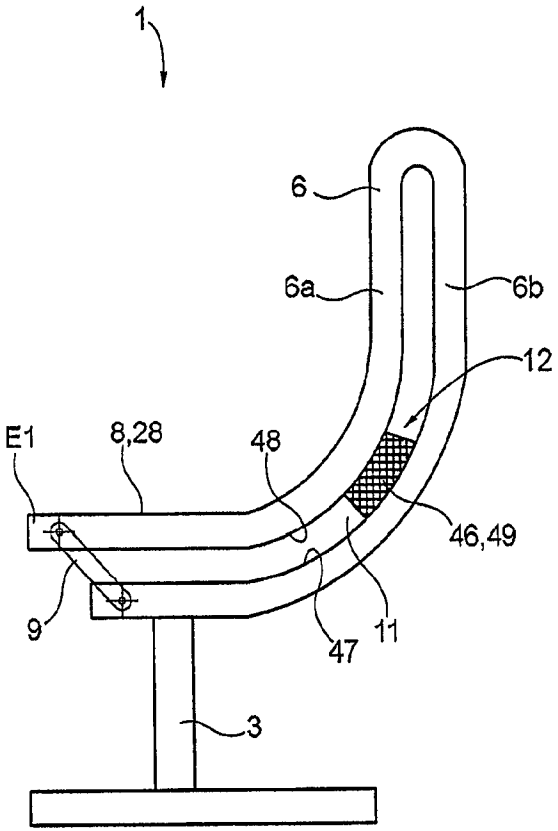
Figure 18:
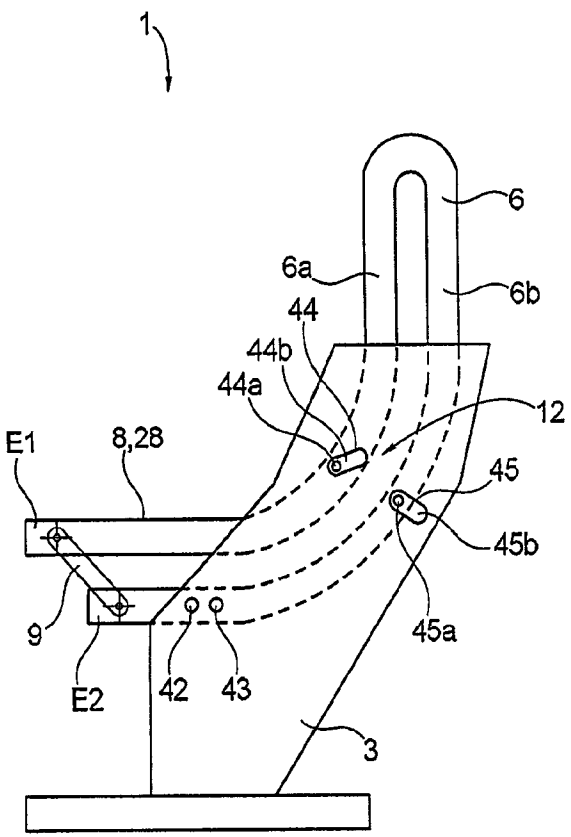
Figure 20:
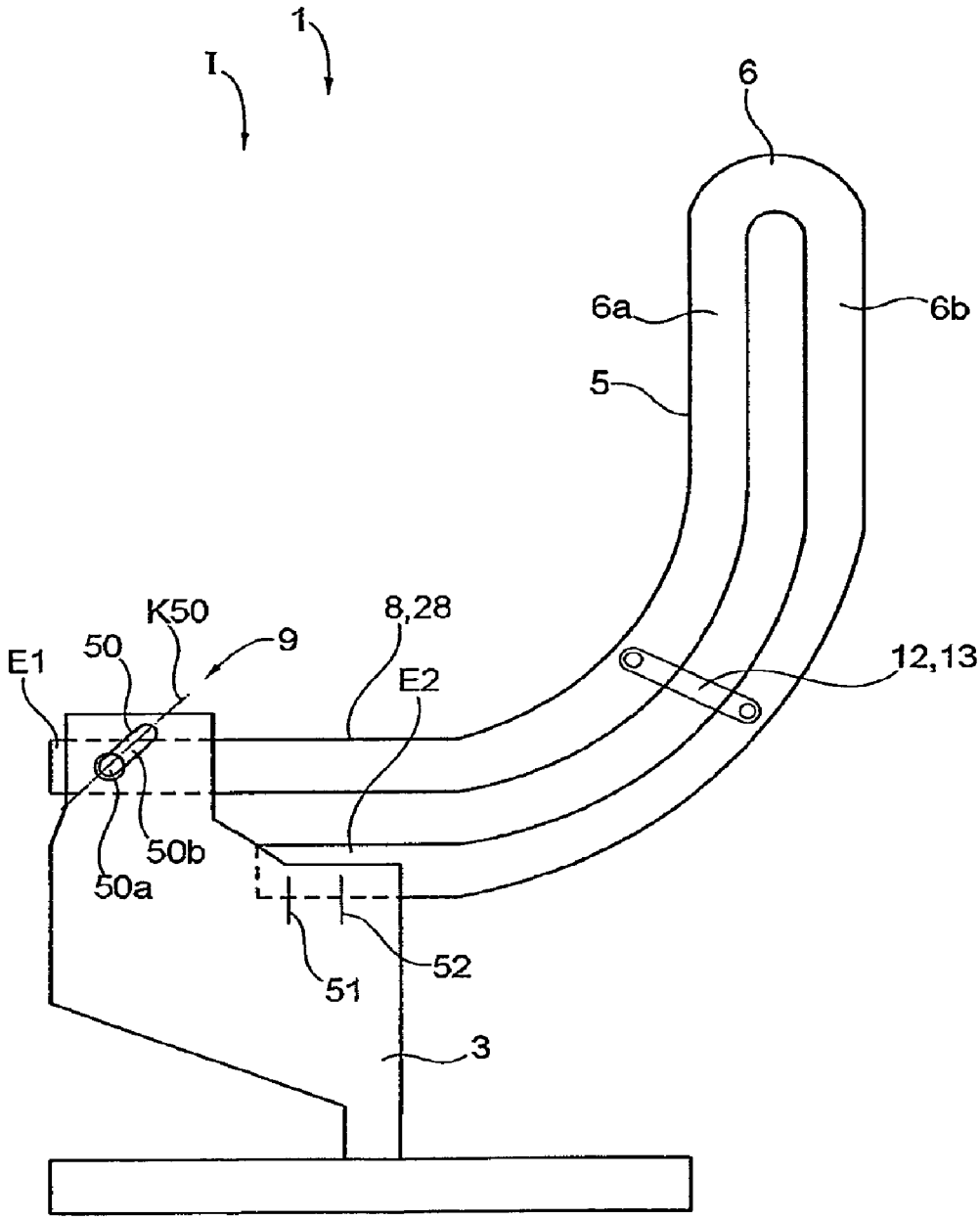

FIGS. 18 to 20 illustrate three further variant embodiments of seats 1 according to the invention. The three seats 1 are designed according to the seat shown in FIG. 1*b* and each have two supporting arms 6 which bear a fabric 8 as the covering 28. In the side views, the second supporting arm is entirely concealed by the first supporting arm 6. For simplification, only the supporting arm 6 is described in each case.

The other supporting arm is constructed comparably in each case and is comparably fastened to an underframe 3.

In the case of the ninth variant embodiment shown in FIG. 18, a lower support 6*b* of the supporting arm 6 is fastened to the underframe 3 of the seat 1 by two bolts 42, 43. A connecting link 12 for connecting the supports 6*a* and 6*b* is formed by two slotted-guide mechanisms 44, 45. The slotted-guide mechanisms 44, 45 respectively comprise a pin 44*a* and 45*a* and a slot 44*b* and 45*b*. The slots 44*b* and 45*b* are formed on the underframe 3, and the pins 44*a* and 45*a* are connected to the supports 6*a* and 6*b*. A free end E1 of the upper support 6*a* is guided on the lower support 6*b* by means of a guide element 9.

In the case of the tenth variant embodiment shown in FIG. 19, a connecting link 12 between an upper support 6*a* and a lower support 6*b* of the supporting arm 6 is formed by an elastic element 46. The elastic element is arranged in an intermediate space 11 between the supports 6*a* and 6*b*. In order also to be able to transmit shearing forces, the elastic element 46 is adhesively bonded to an upper side 47 of the lower support 6*b* and to a lower side 48 of the upper support 6*a*. The elastic element 46 is designed, for example, as a rubber block 49. The supporting arm 6 is fastened by its lower support 6*b* on the underframe 3. A free end E1 of the upper support 6*a* is guided on the lower support 6*b* via a guide element 9.

In the case of the eleventh variant embodiment shown in FIG. 20, a connecting link 12 between an upper support 6*a* and a lower support 6*b* of the supporting arm 6 is designed as a lever 13, as already known from preceding exemplary embodiments. In contrast to the preceding exemplary embodiments, a guide element 9 is formed by a slotted-guide mechanism 50. The latter comprises a pin 50*a* and a slot 50*b*. The pin 50*a* is fastened to a free end E1 of the upper support 6*a* and slides in the slot 50*b*, which is formed on the lower part 3. During a movement of the seat element 1 from the basic position I illustrated in FIG. 20 into a resting position, the pin 50*a* and the upper support 6*a* connected thereto move upwards on a curve K50 in the direction of a backrest part 5. The lower support 6*b* is screwed at a free end E2 to the underframe by means of two screws 51, 52.

The invention is not restricted to exemplary embodiments illustrated or described. On the contrary, it includes developments of the invention within the scope of the claims.

LIST OF DESIGNATIONS

1 SEAT
2 SEAT ELEMENT
3 UNDERFRAME
4 SEAT PART
4A FRONT SEAT PART
4B REAR SEAT PART
5 BACKREST PART
5A LOWER BACKREST PART
5B UPPER BACKREST PART
6 SUPPORTING ARM
6A UPPER SUPPORT OF 6
6A' SECOND, UPPER SUPPORT OF 6
6B LOWER SUPPORT OF 6
7 SUPPORTING ARM
7A UPPER SUPPORT OF 7
7B LOWER SUPPORT OF 7
8 FABRIC
9 GUIDE ELEMENT
10 LEVER
11 INTERMEDIATE SPACE BETWEEN 6A, 6B AND 7A, 7B
12 CONNECTING LINK
13 LEVER
14 TRANSVERSE SUPPORT BETWEEN 6B AND 7B
15 ENERGY STORE
16 SPRING ELEMENT
17 LEAF SPRING
18 STOP ON 6A
19 CONTACT BODY
20 TRANSVERSE STRUT BETWEEN 6 AND 7 AND 6B AND 7B
21 TRANSVERSE STRUT BETWEEN 6 AND 7 AND 6B AND 7B
22 FOOTPLATE OF 3
23 STRUT BETWEEN 22 AND 14
24 FASTENING POINT OF 6B/7B ON 14
25 FASTENING POINT OF 6B/7B ON 14
26 TRANSVERSE SLAT
27 SPOKE
28 COVERING
29 SEAT SURFACE
30 BACKREST
31 TRANSVERSE SUPPORT BETWEEN 6A AND 6A'
32 TRANSVERSE SUPPORT BETWEEN 6A AND 6A'
33 APPROXIMATELY VERTICALLY SITUATED LIMB OF 6B
33A STRUT ON 33
33B STRUT ON 33
34 UPWARDLY DIRECTED LIMB OF 6A
35 UPWARDLY DIRECTED LIMB OF 6A'
36 APPROXIMATELY HORIZONTALLY SITUATED LIMB OF 6B
37 FREE END OF 36
38 APPROXIMATELY HORIZONTALLY SITUATED LIMB OF 6A
39 APPROXIMATELY HORIZONTALLY SITUATED LIMB OF 6A'
40 STRUT
41 VERTICAL PLANE
42 BOLT
43 BOLT
44 SLOTTED-GUIDE MECHANISM
44A PIN
44B SLOT
45 SLOTTED-GUIDE MECHANISM AS CONNECTING LINK
45A PIN
45B SLOT
46 ELASTIC ELEMENT BETWEEN 6A AND 6B
47 UPPER SIDE OF 6B
48 LOWER SIDE OF 6A
49 RUBBER BLOCK
50 SLOTTED-GUIDE MECHANISM AS GUIDE ELEMENT
50A PIN
50B SLOT
51 SCREW FOR FASTENING 6B TO 3
52 SCREW FOR FASTENING 6B TO 3
I BASIC POSITION OF 1 AND 2
II RESTING POSITION OF 1 AND 2
III INTERMEDIATE POSITION BETWEEN I AND II
A REGION OF 4A
B6 WIDTH OF 6
B REGION OF 4B
C REGION OF 5A
D REGION OF 5B

D91 PIVOTAL POINT OF 9 ON 6A
D92 PIVOTAL POINT OF 9 ON 6B
D121 PIVOTAL POINT OF 12 ON 6A
D122 PIVOTAL POINT OF 12 ON 6B
E1 END OF 6A
E2 END OF 6B
H1 DISPLACEMENT OF D91 IN Y DIRECTION
H HORIZONTAL
K9 ARCUATE PATH OF D91
K12 ARCUATE PATH OF D121
K50 CURVE OF 50A
K CIRCULAR PATH OF D91 ABOUT D92
L1 DISPLACEMENT OF D91 IN X DIRECTION
M PULLING DIRECTION OF 6A
P POINT ON 6
Q CENTRAL SECTION OF 6A
Q' CENTRAL SECTION OF 6A'
R CENTRAL SECTION OF 6B
W4 ANGLE BETWEEN 4 AND H
W5 ANGLE BETWEEN 5 AND V
W6 OPENING ANGLE BETWEEN 4 AND 5
W9 ANGLE BETWEEN 9 AND H
WP ROCKING POINT
V1 DISPLACEMENT DISTANCE OF 19 IN Y' DIRECTION
V VERTICAL
α INNER OPENING ANGLE
β DIFFERENCE BETWEEN THE ANGLES W9
γ DIFFERENCE BETWEEN DIFFERENT ANGLES OF 12

The invention claimed is:

1. A seating structure comprising:

a base;

a pair of laterally spaced support arms each comprising a seat portion, a backrest portion and a transition portion joining said seat portion and backrest portion, wherein said laterally spaced support arms are coupled to said base;

a body support member extending between and connected to said laterally spaced support arms and comprising at least a seat portion, a backrest portion, and a transition portion integrally formed with said seat portion and said backrest portion;

a support element coupled to said base and comprising a central support arm extending upwardly along a centerline of said backrest portion of said body support member, wherein said central support arm is spaced rearwardly from said backrest portions of said laterally spaced support arms, said support element further comprising a pair of laterally extending struts connecting said central support arm and said laterally spaced support arms.

2. The seating structure of claim 1 further comprising a cross member connecting upper ends of each of said backrest portions of said laterally spaced support arms.

3. The seating structure of claim 1 wherein said body support member comprises a flexible membrane.

4. The seating structure of claim 3 wherein said flexible membrane comprises a fabric.

5. The seating structure of claim 1 wherein each of said laterally spaced support arms is generally L-shaped.

6. The seating structure of claim 1 wherein said struts are connected to said laterally spaced support arms at a location spaced below upper ends of said laterally spaced support arms.

7. The seating structure of claim 1 wherein said support element comprises a forwardly extending limb spaced below the seat portions of said laterally spaced support arms.

8. The seating structure of claim 7 wherein said limb is connected to said base.

9. The seating structure of claim 7 wherein said limb is connected to said seat portions of said laterally spaced support arms with at least a pair of links.

10. The seating structure of claim 1 wherein said seat portion of each of said laterally spaced support arms is pivotally coupled to said base with a link.

11. A seating structure comprising:

a base;

a support member comprising a seat portion, a backrest portion and a transition portion joining said seat portion and backrest portion, wherein said support member is coupled to said base, said backrest portion moveable relative to said seat portion as said support member is moved between upright and reclined positions, wherein said support member is elastically deformed as said support member is moved between said upright and reclined positions, wherein said support member comprises a pair of laterally spaced support arms each having said backrest and transition portions; and a support element coupled to said base and having an upper portion connected to said backrest portion of said support member at a location above a lumbar region of said backrest portion, wherein said support element comprises a central support arm extending upwardly between said laterally spaced support arms, said support element further comprising a pair of laterally extending struts connecting said central support arm and said laterally spaced support arms.

12. The seating structure of claim 11 wherein said central support arm is spaced rearwardly from said backrest portions of said laterally spaced support arms.

13. The seating structure of claim 11 further comprising a body support member extending between and connected to said laterally spaced support arms and comprising at least a seat portion and a backrest portion.

14. The seating structure of claim 11 further comprising a cross member connecting upper ends of each of said backrest portions of said laterally spaced support arms.

15. The seating structure of claim 11 wherein said support element comprises a forwardly extending limb spaced below the seat portions of said laterally spaced support arms.

16. The seating structure of claim 15 wherein said limb is connected to said base.

17. The seating structure of claim 15 wherein said limb is connected to said seat portions of said laterally spaced support arms with at least a pair of links.

18. The seating structure of claim 11 wherein said seat portion of each of said laterally spaced support arms is pivotally coupled to said base with a link.

* * * * *